US011944150B2

(12) United States Patent
Pietrzak et al.

(10) Patent No.: US 11,944,150 B2
(45) Date of Patent: Apr. 2, 2024

(54) HELMET

(71) Applicant: MIPS AB, Täby (SE)

(72) Inventors: Christopher Pietrzak, Täby (SE); Saman Xie, Täby (SE)

(73) Assignee: MIPS AB, Taby (SE)

( * ) Notice: Subject to any disclaimer, the term of this patent is extended or adjusted under 35 U.S.C. 154(b) by 323 days.

(21) Appl. No.: 17/299,538

(22) PCT Filed: Dec. 3, 2019

(86) PCT No.: PCT/EP2019/083532
§ 371 (c)(1),
(2) Date: Jun. 3, 2021

(87) PCT Pub. No.: WO2020/115063
PCT Pub. Date: Jun. 11, 2020

(65) Prior Publication Data

US 2022/0031005 A1 Feb. 3, 2022

(30) Foreign Application Priority Data

Dec. 4, 2018 (GB) ..... 1819779
Aug. 16, 2019 (GB) ..... 1911791

(51) Int. Cl.
*A42B 3/06* (2006.01)
*A42B 3/14* (2006.01)

(52) U.S. Cl.
CPC ..... *A42B 3/14* (2013.01)

(58) Field of Classification Search
CPC ..... A42B 3/064; A42B 3/127; A42B 3/14
See application file for complete search history.

(56) References Cited

U.S. PATENT DOCUMENTS 6,701,535 B2 * 3/2004 Dobbie ..... A42B 3/085 2/6.1
7,854,023 B2 * 12/2010 Ando ..... A42B 3/328 2/424

(Continued)

FOREIGN PATENT DOCUMENTS

CN 102905570 1/2013
CN 104356517 2/2015

(Continued)

OTHER PUBLICATIONS

Farkhatdinov, "Modelling vertically estimation during locomotion", Thesis Université Pierre et Marie Curie—Paris VI, 2013. 110 pages.

(Continued)

*Primary Examiner* — Tajash D Patel
(74) *Attorney, Agent, or Firm* — NORTON ROSE FULBRIGHT US LLP

(57) ABSTRACT

The present invention provides a helmet, comprising first and second components having a sliding interface between them, wherein the sliding interface is provided between respective sliding surfaces of the first and second components, and the first component comprises (a) a mixture of (i) an olefin polymer, (ii) a lubricant, and optionally one or more further agents; or (b) an ultra high molecular weight (UHMW) polymer having a density of ≤960 kg/m$^3$, which UHMW polymer is preferably an olefin polymer.

22 Claims, 10 Drawing Sheets

(56) References Cited

U.S. PATENT DOCUMENTS

| | | | | |
|---|---|---|---|---|
| 8,863,319 | B2 * | 10/2014 | Knight | A42B 3/14 2/411 |
| 9,095,179 | B2 * | 8/2015 | Kwan | A42B 3/063 |
| 9,681,697 | B2 * | 6/2017 | Ikeda | A42B 3/142 |
| 2004/0117896 | A1 | 6/2004 | Madey et al. | |
| 2004/0168246 | A1 | 9/2004 | Phillips | |
| 2004/0169246 | A1 | 9/2004 | Hsieh | |
| 2016/0316829 | A1 | 11/2016 | Guerra | |
| 2017/0013907 | A1 | 1/2017 | Salmini et al. | |
| 2017/0164678 | A1 | 6/2017 | Allen et al. | |
| 2018/0213874 | A1 | 8/2018 | Lanner et al. | |

FOREIGN PATENT DOCUMENTS

| | | |
|---|---|---|
| CN | 105324048 | 2/2016 |
| CN | 207125380 | 3/2018 |
| CN | 107635423 | 7/2021 |
| EP | 0790787 | 8/1997 |
| EP | 2535374 | 12/2012 |
| EP | 3581052 | 12/2019 |
| GB | 1719559.5 | 11/2017 |
| JP | 2003335939 | 11/2003 |
| KR | 20050077107 | 8/2005 |
| TW | 311921 | 8/1997 |
| TW | I513717 | 12/2015 |
| TW | 201735809 | 10/2017 |
| TW | 201735810 | 10/2017 |
| TW | 201826957 | 8/2018 |
| TW | I680727 B | 1/2020 |
| WO | WO 1996/014768 | 5/1996 |
| WO | WO 1996/026978 | 9/1996 |
| WO | WO 2001/045526 | 6/2001 |
| WO | WO 2011/139224 | 11/2011 |
| WO | WO 2012/032665 | 3/2012 |
| WO | WO 2017/148958 | 9/2017 |
| WO | WO 2017/157765 | 9/2017 |
| WO | WO 2018/108940 | 6/2018 |
| WO | WO 2019/101816 | 5/2019 |

OTHER PUBLICATIONS

International Search Report and Written Opinion for Application No. PCT/EP2019/083532, dated Feb. 17, 2020, 3 pages.

Kleiven, "Finite Element Modeling of the Human Head", Doctoral Thesis,, Department of Aeronautics, Royal Institute of Technology, Stockholm, Sweden, (2002), 63 pages.

Kleiven, "Evaluation of head injury criteria using a finite element model validated against experiments on localized brain motion, intracerebral acceleration, and intracranial pressure", (2006), International Journal of Crashworthiness 11 (1), pp. 65-79.

Kleiven, "Predictors for Traumatic Brain Injuries Evaluated through Accident Reconstructions", Stapp Car Crash Journal, 51, Oct. 2007, 36 pages.

Safety Data Sheet: Woven Sheet of Ultra High Molecular Weight Polyethylene tape from DSM Dyneema, Aug. 30, 2013, pp. 1-8.

Office Action issued in Corresponding Chinese Application No. 201980090770.0, dated Oct. 11, 2023 (No English Translation provided).

* cited by examiner

HELMET

This application is a national phase application under 35 U.S.C. § 371 of International Application No. PCT/EP2019/083532, filed Dec. 3, 2019, which claims priority to and the benefit of United Kingdom Applications No. 1819779.8, filed Dec. 4, 2018, and No. 1911791.0, filed Aug. 16, 2019. The contents of the referenced patent applications are incorporated into the present application by reference.

The present invention relates to helmets. In particular the present invention relates to helmets that include a sliding interface between two components.

Helmets are known for use in various activities. These activities include combat and industrial purposes, such as protective helmets for soldiers and hard-hats or helmets used by builders, mine-workers, or operators of industrial machinery for example. Helmets are also common in sporting activities. For example, protective helmets may be used in ice hockey, cycling, motorcycling, motor-car racing, skiing, snowboarding, skating, skateboarding, equestrian activities, American football, baseball, rugby, soccer, cricket, lacrosse, climbing, golf, airsoft and paintballing.

Helmets can be of fixed size or adjustable, to fit different sizes and shapes of head. In some types of helmet, e.g. commonly in ice-hockey helmets, the adjustability can be provided by moving parts of the helmet to change the outer and inner dimensions of the helmet. This can be achieved by having a helmet with two or more parts which can move with respect to each other. In other cases, e.g. commonly in cycling helmets, the helmet is provided with an attachment device for fixing the helmet to the user's head, and it is the attachment device that can vary in dimension to fit the user's head whilst the main body or shell of the helmet remains the same size. In some cases, comfort padding within the helmet can act as the attachment device. The attachment device can also be provided in the form of a plurality of physically separate parts, for example a plurality of comfort pads which are not interconnected with each other. Such attachment devices for seating the helmet on a user's head may be used together with additional strapping (such as a chin strap) to further secure the helmet in place. Combinations of these adjustment mechanisms are also possible.

Helmets are often made of an outer shell, that is usually hard and made of a plastic or a composite material, and an energy absorbing layer called a liner. In other arrangements, such as a rugby scrum cap, a helmet may have no hard outer shell, and the helmet as a whole may be flexible. In any case, nowadays, a protective helmet has to be designed so as to satisfy certain legal requirements which relate to inter alia the maximum acceleration that may occur in the centre of gravity of the brain at a specified load. Typically, tests are performed, in which what is known as a dummy skull equipped with a helmet is subjected to a radial blow towards the head. This has resulted in modern helmets having good energy-absorption capacity in the case of blows radially against the skull. Progress has also been made (e.g. WO 2001/045526 and WO 2011/139224, which are both incorporated herein by reference, in their entireties) in developing helmets to lessen the energy transmitted from oblique blows (i.e. which combine both tangential and radial components), by absorbing or dissipating rotation energy and/or redirecting it into translational energy rather than rotational energy.

Other helmets described in the art include one having an inner shell which mimics the skull and an outer layer designed to mimic the scalp (US 2004/168246), ones having an interface layer that may be a distensible flexible envelope or a hyper-elastic gel (US 2004/117896), and ones featuring a membrane of ethylene vinyl acetate co-polymers attached to the interior of a glass reinforced plastic shell (WO 96/14768).

Oblique impacts (in the absence of protection) result in both translational acceleration and angular acceleration of the brain. Angular acceleration causes the brain to rotate within the skull creating injuries on bodily elements connecting the brain to the skull and also to the brain itself.

Examples of rotational injuries include Mild Traumatic Brain Injuries (MTBI) such as concussion, and Severe Traumatic Brain Injuries (STBI) such as subdural haematomas (SDH), bleeding as a consequence of blood vessels rapturing, and diffuse axonal injuries (DAI), which can be summarized as nerve fibres being over stretched as a consequence of high shear deformations in the brain tissue.

Depending on the characteristics of the rotational force, such as the duration, amplitude and rate of increase, either concussion, SDH, DAI or a combination of these injuries can be suffered. Generally speaking, SDH occur in the case of accelerations of short duration and great amplitude, while DAI occur in the case of longer and more widespread acceleration loads.

In helmets such as those disclosed in WO 2001/045526 and WO 2011/139224 that may reduce the rotational energy transmitted to the brain caused by oblique impacts, two parts of the helmet may be configured to slide relative to each other following an oblique impact. Connectors may be provided that, whilst connecting the parts of a helmet together, permit movement of the parts relative to each other under an impact.

In order to provide such a helmet, it may be desirable to provide two components that can slide relative to each other, providing a sliding interface. It may also be desirable to be able to provide such a sliding interface without substantially increasing the manufacturing costs and/or effort.

According to an aspect of the invention, there is provided a helmet, comprising first and second components having a sliding interface between them, wherein the sliding interface is provided between respective sliding surfaces of the first and second components, and the first component comprises (a) a mixture of (i) an olefin polymer, (ii) a lubricant, and optionally one or more further agents; or (b) an ultra high molecular weight (UHMW) polymer having a density of $\leq 960$ kg/m$^3$, which UHMW polymer is preferably an olefin polymer.

Preferred aspects of the first and second components are discussed further below.

In a first arrangement, the helmet comprises at least one section having first and second layers, configured in use to be respectively further from the local surface of the head of a wearer of the helmet and closer to the local surface of the head of a wearer of the helmet; and the helmet is configured such that, in response to an impact on the helmet, the first layer can move relative to the second layer in a direction tangential to the local surface of the head.

In one embodiment of the first arrangement, the sliding interface is provided between the first and second layers. Thus, one of the first and second layers comprises the first component, and the other of the first and second layers comprises the second component.

In a second arrangement, the first layer may comprise a relatively hard outer shell; the second layer may comprise a shell formed from an impact energy absorbing material; and one of the first and second layers may comprise the first component.

In a third arrangement, the first and second layers may comprise shells formed from an impact energy absorbing material; and one of the first and second layers may comprise the first component.

In a fourth arrangement, the first layer may comprise a shell formed from an impact energy absorbing material; the second layer may not absorb a significant proportion of impact energy in comparison to the first layer, and one of the first and second layers may comprise the first component. The second layer may comprise comfort padding.

In a fifth arrangement (which may be an embodiment of the first arrangement defined above), the helmet may further comprise a connector, configured to connect the first and second layers of the helmet together but permit relative movement in the direction tangential to the local surface of the head in response to an impact on the helmet; and the connector may comprise at least one of the first component and the second component.

In a sixth arrangement (which may be an embodiment of the second, third or fourth arrangement defined above), the helmet may further comprise a connector, configured to connect the first and second layers of the helmet together but permit relative movement in the direction tangential to the local surface of the head in response to an impact on the helmet;

wherein the connector comprises at least one of a second first component and a second second component.

The invention is described in detail, below, with reference to the accompanying figures, in which.

Figure 4:
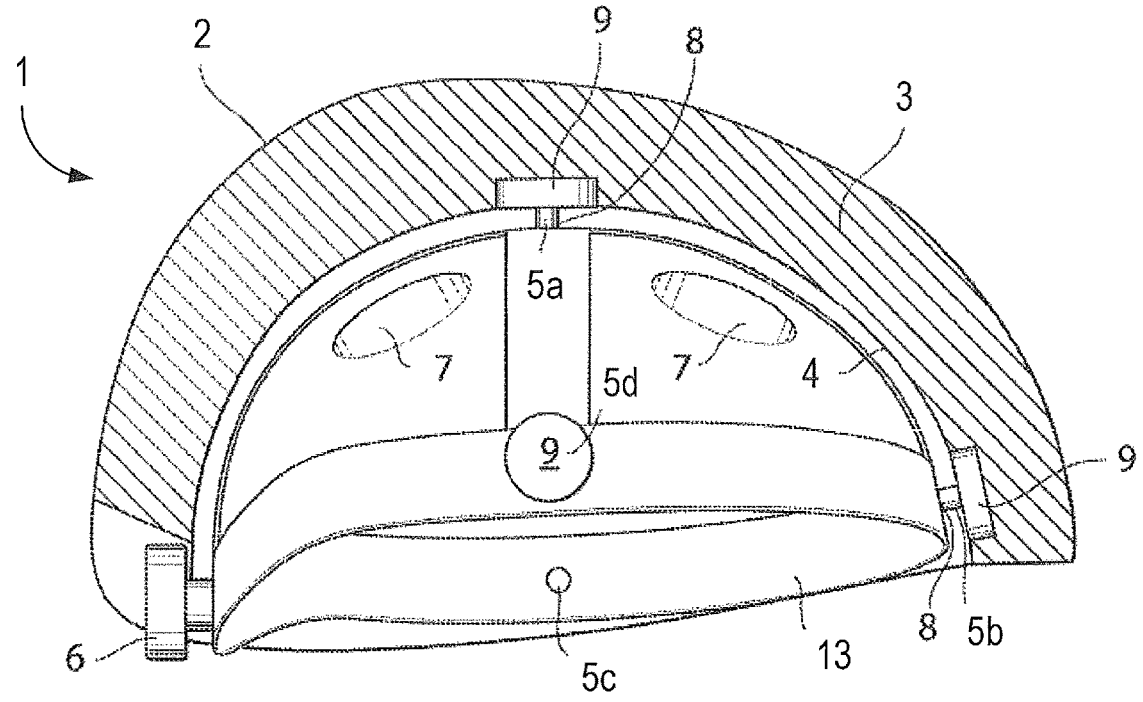
Figure 5:
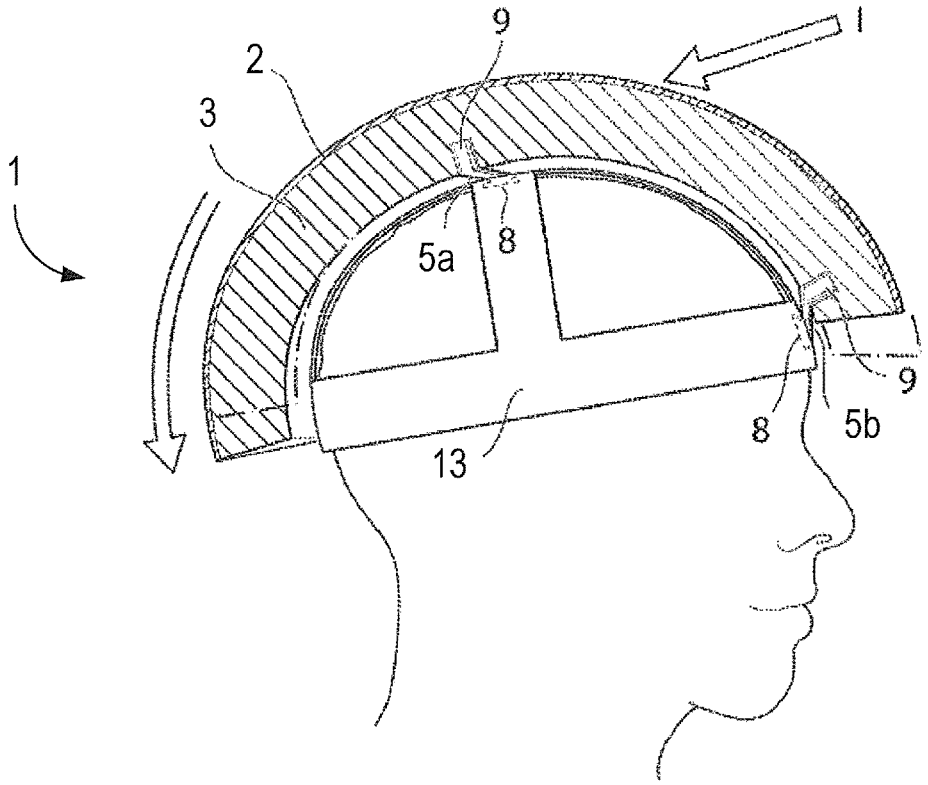
Figure 10:
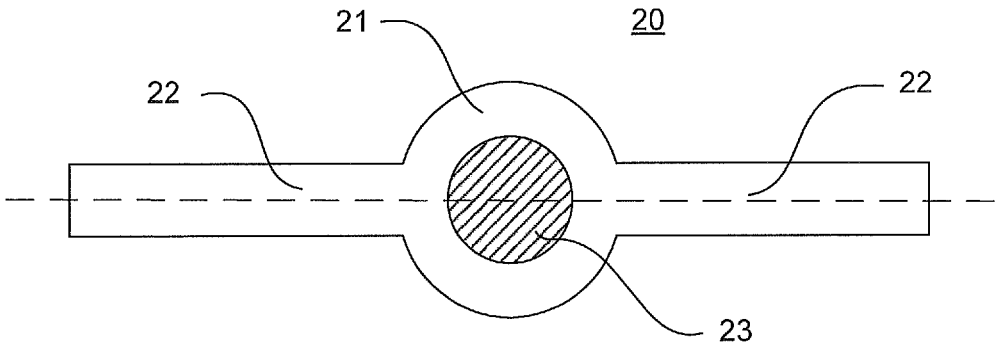
Figure 11:
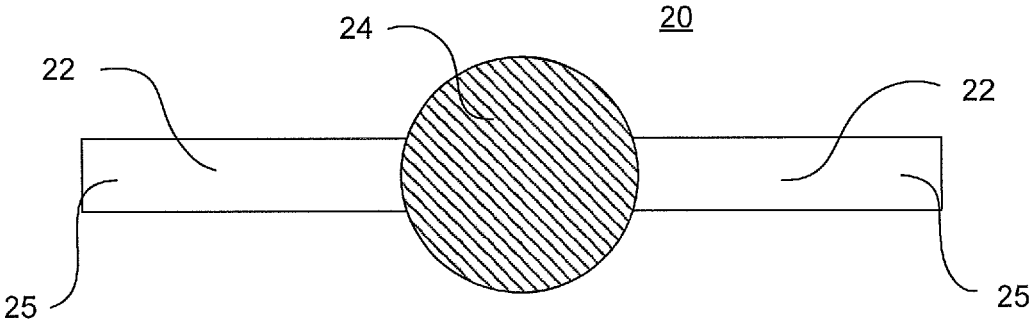
Figure 12:
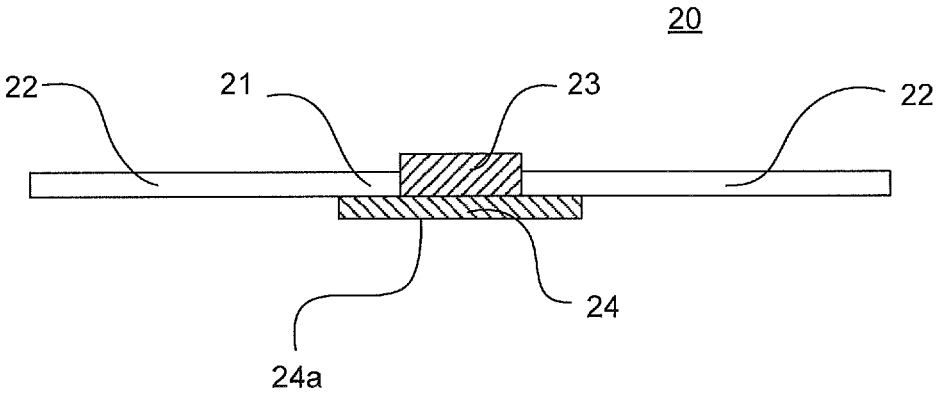
Figure 13:
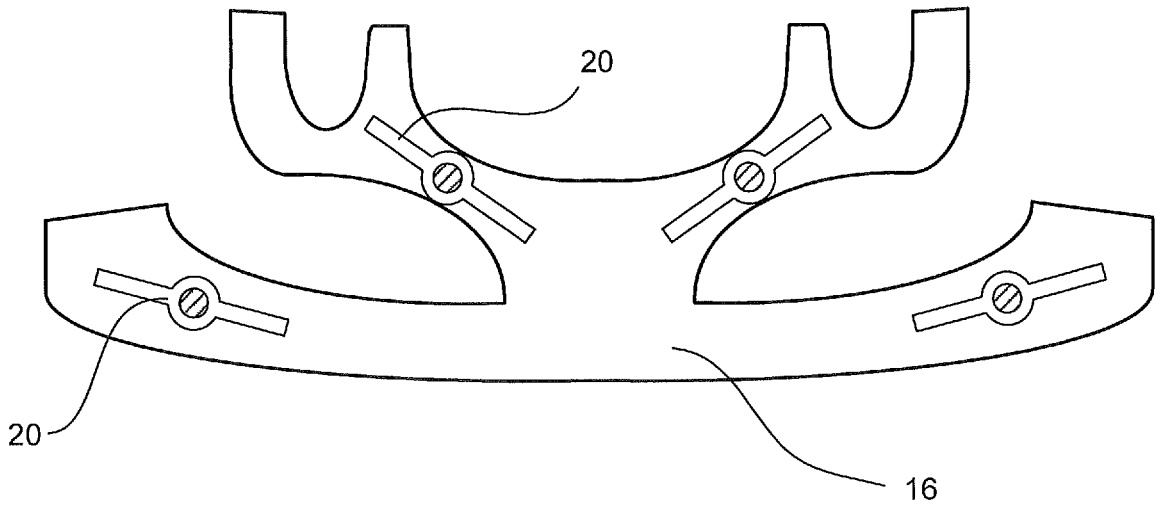
Figure 14:
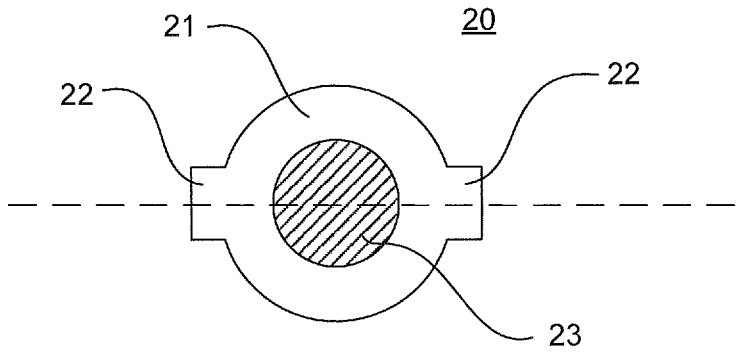
Figure 15:
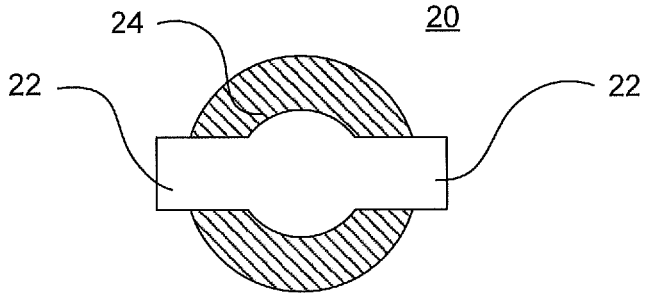

FIGS. 4 and 5 schematically depict another arrangement of a helmet;

FIGS. 6 to 9 schematically depict further arrangements of helmets;

FIG. 10 schematically depicts, a top (plan) view of a connector that may be used in a helmet;

FIG. 11 schematically depicts a bottom (plan) view, of the connector of FIG. 10;

FIG. 12 schematically depicts a cross-sectional side view of the connector of FIG. 10;

FIG. 13 schematically depicts comfort padding comprising the connectors of FIG. 10;

FIG. 14 schematically depicts a top (plan) view of another connector that may be used in a helmet;

FIG. 15 schematically depicts a bottom (plan) view, of the connector of FIG. 14

Figure 16:
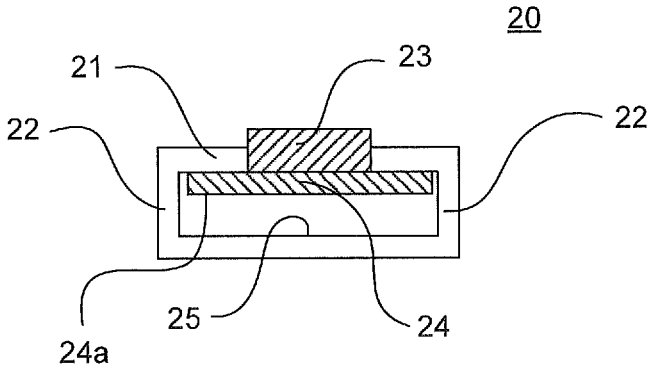
Figure 17:
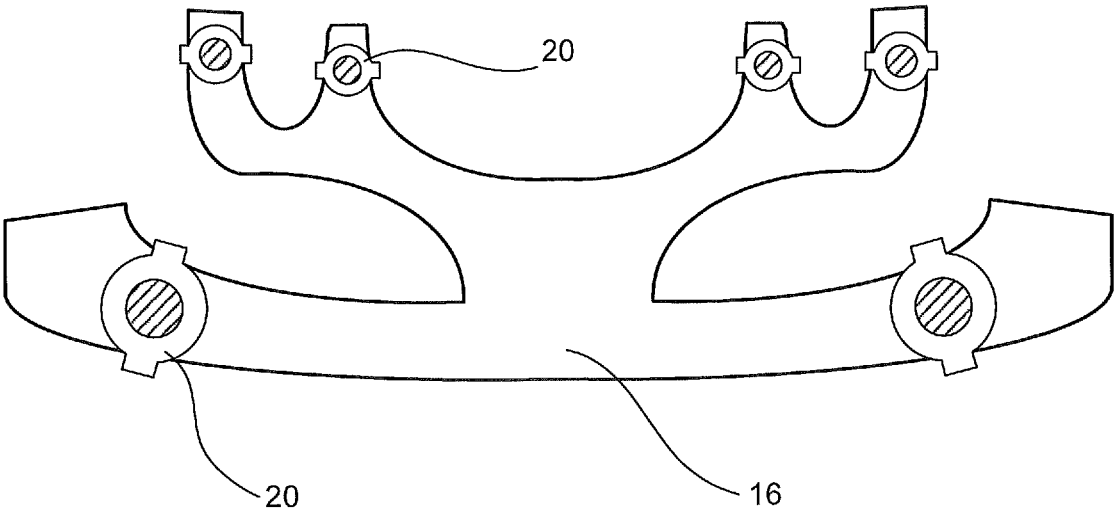
Figure 18:
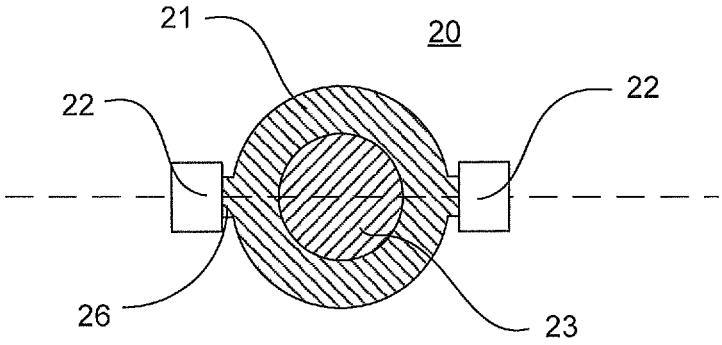
Figure 19:
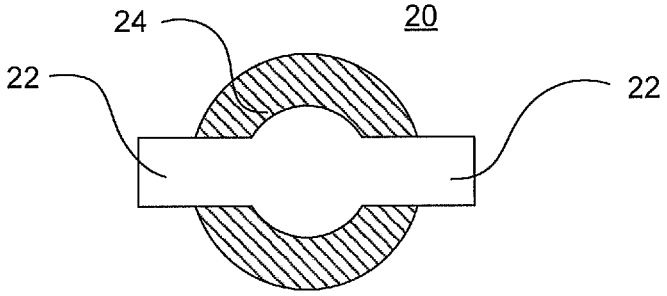
Figure 20:
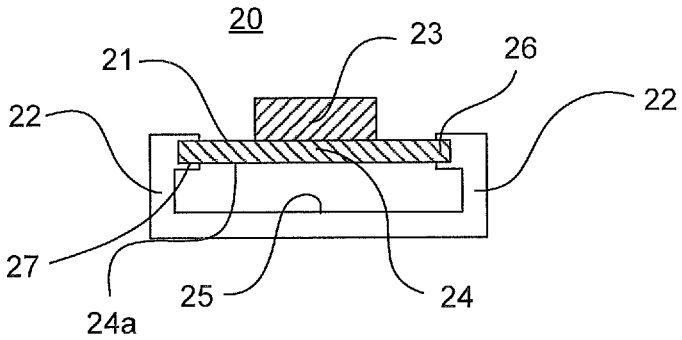

FIG. 16 schematically depicts a cross-sectional side view of the connector of FIG. 14;

FIG. 17 schematically depicts comfort padding comprising the connectors of FIG. 14;

FIG. 18 schematically depicts a top (plan) view of another connector that may be used in a helmet;

FIG. 19 schematically depicts a bottom (plan) view, of the connector of FIG. 18; and FIG. 20 schematically depicts a cross-sectional side view of the connectors of FIG. 18.

Figure 21:
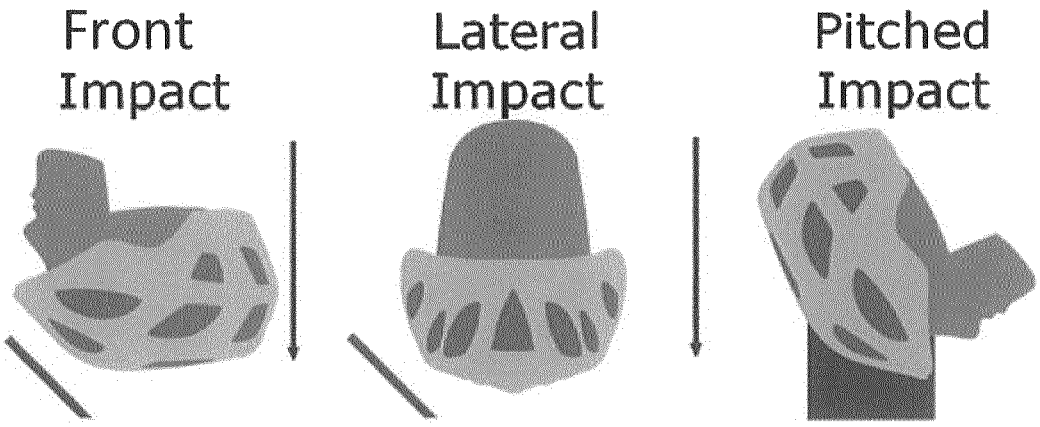

FIG. 21 schematically depicts the three different impact directions that were used to assess the ability of helmets to protect against impacts.

Figure 22:
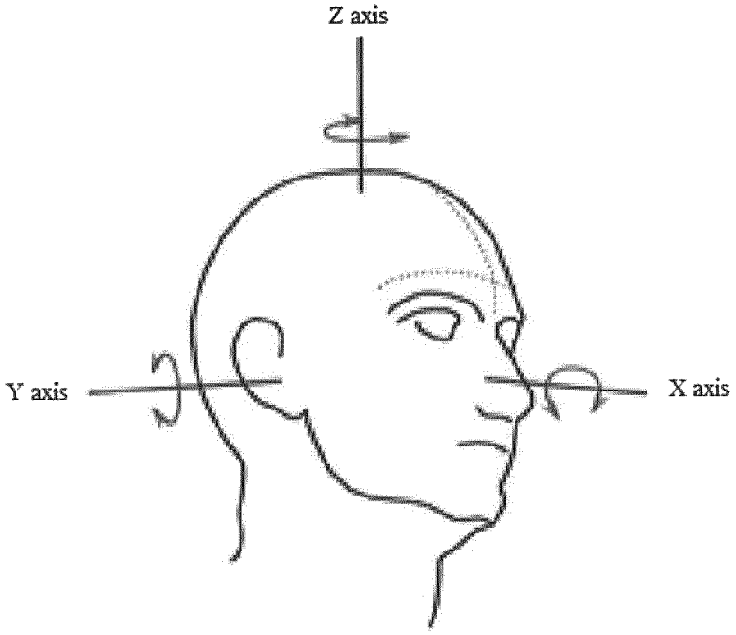

FIG. 22 schematically depicts the spatial positions of the X, Y and Z-axes in relation to the human head.

The proportions of the thicknesses of the various layers in the helmets depicted in the figures have been exaggerated in the drawings for the sake of clarity and can of course be adapted according to need and requirements.

Figure 1:
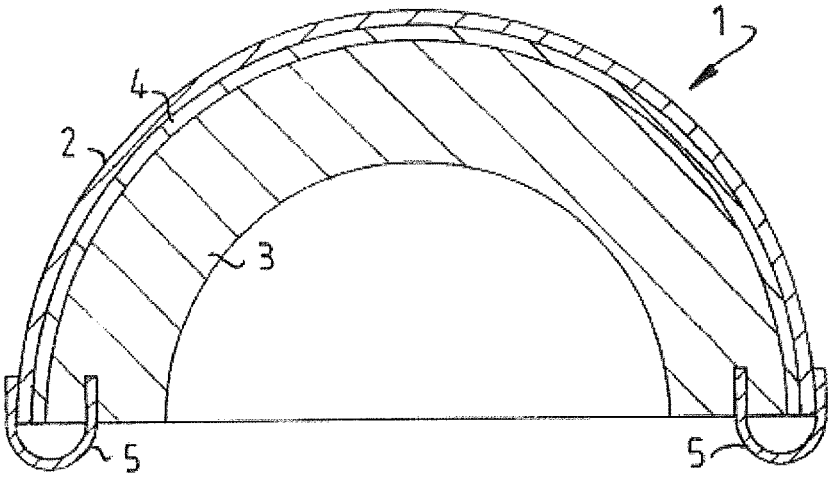
FIG. 1 depicts a cross-section through a helmet for providing protection against oblique impacts.

FIG. 1 depicts a first helmet 1 of the sort discussed in WO 01/45526, intended for providing protection against oblique impacts. This type of helmet could be any of the types of helmet discussed above.

Protective helmet 1 is constructed with an outer shell 2 and, arranged inside the outer shell 2, an inner shell 3 that is intended for contact with the head of the wearer.

Arranged between the outer shell 2 and the inner shell 3 is a sliding layer 4 or a sliding facilitator, which may enable displacement between the outer shell 2 and the inner shell 3. In particular, a sliding layer 4 or sliding facilitator may be configured such that sliding may occur between two parts during an impact. For example, it may be configured to enable sliding under forces associated with an impact on the helmet 1 that is expected to be survivable for the wearer of the helmet 1. In some arrangements, it may be desirable to configure the sliding layer or sliding facilitator such that the coefficient of friction is between 0.001 and 0.3 and/or below 0.15.

Arranged in the edge portion of the helmet 1, in the FIG. 1 depiction, may be one or more connecting members 5 which interconnect the outer shell 2 and the inner shell 3. In some arrangements, the connectors may counteract mutual displacement between the outer shell 2 and the inner shell 3 by absorbing energy. However, this is not essential. Further, even where this feature is present, the amount of energy absorbed is usually minimal in comparison to the energy absorbed by the inner shell 3 during an impact. In other arrangements, connecting members 5 may not be present at all.

Further, the location of these connecting members 5 can be varied (for example, being positioned away from the edge portion, and connecting the outer shell 2 and the inner shell 3 through the sliding layer 4).

The outer shell 2 is preferably relatively thin and strong so as to withstand impact of various types. The outer shell 2 could be made of a polymer material such as polycarbonate (PC), polyvinylchloride (PVC) or acrylonitrile butadiene styrene (ABS) for example. Advantageously, the polymer material can be fibre-reinforced, using materials such as glass-fibre, Aramid, Twaron, carbon-fibre or Kevlar.

The inner shell 3 is considerably thicker and acts as an energy absorbing layer. As such, it is capable of damping or absorbing impacts against the head. It can advantageously be made of foam material like expanded polystyrene (EPS), expanded polypropylene (EPP), expanded polyurethane (EPU), vinyl nitrile foam; or other materials forming a honeycomb-like structure, for example; or strain rate sensitive foams such as those marketed under the brand-names Poron™ and D3O™. The construction can be varied in different ways, which emerge below, with, for example, a number of layers of different materials.

Inner shell 3 is designed for absorbing the energy of an impact. Other elements of the helmet 1 will absorb that energy to a limited extent (e.g. the hard outer shell 2 or so-called 'comfort padding' provided within the inner shell 3), but that is not their primary purpose and their contribution to the energy absorption is minimal compared to the energy absorption of the inner shell 3. Indeed, although some other elements such as comfort padding may be made of 'compressible' materials, and as such considered as 'energy absorbing' in other contexts, it is well recognised in the field of helmets that compressible materials are not necessarily 'energy absorbing' in the sense of absorbing a meaningful amount of energy during an impact, for the purposes of reducing the harm to the wearer of the helmet.

A number of different materials and embodiments can be used as the sliding layer 4 or sliding facilitator, for example oil, Teflon, microspheres, air, rubber, polycarbonate (PC), a fabric material such as felt, etc. Such a layer may have a thickness of roughly 0.1-5 mm, but other thicknesses can also be used, depending on the material selected and the performance desired. The number of sliding layers and their positioning can also be varied, and an example of this is discussed below (with reference to FIG. 3B).

As connecting members 5, use can be made of, for example, deformable strips of plastic or metal which are anchored in the outer shell and the inner shell in a suitable manner.

Figure 2:
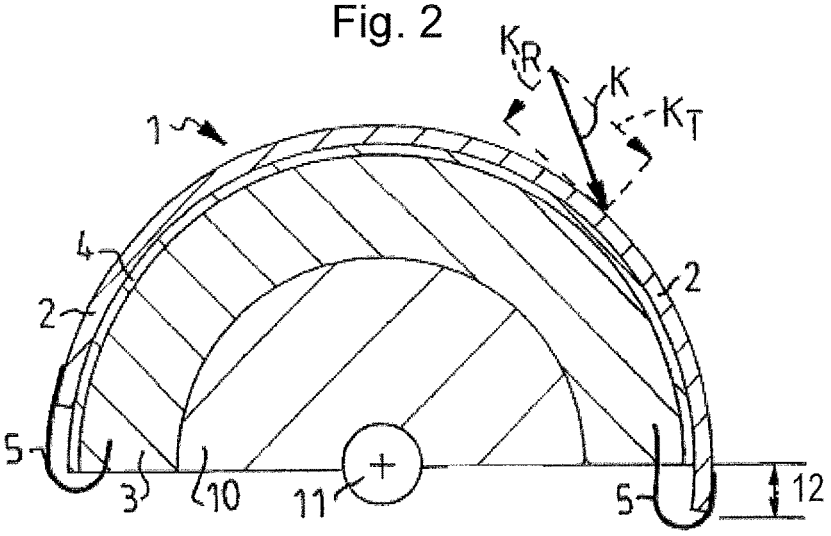
FIG. 2 is a diagram showing the functioning principle of the helmet of FIG. 1.

FIG. 2 shows the functioning principle of protective helmet 1, in which the helmet 1 and a skull 10 of a wearer are assumed to be semi-cylindrical, with the skull 10 being mounted on a longitudinal axis 11. Torsional force and torque are transmitted to the skull 10 when the helmet 1 is subjected to an oblique impact K. The impact force K gives rise to both a tangential force KT and a radial force KR against the protective helmet 1. In this particular context, only the helmet-rotating tangential force KT and its effect are of interest.

As can be seen, the force K gives rise to a displacement 12 of the outer shell 2 relative to the inner shell 3, the connecting members 5 being deformed. Significant reductions in the torsional force transmitted to the skull 10 can be obtained with such an arrangement—a typical reduction may be roughly 25%, though reductions as high as 90% may be possible in some instances. This is a result of the sliding motion between the inner shell 3 and the outer shell 2 reducing the amount of energy which is transferred into radial acceleration.

Sliding motion can also occur in the circumferential direction of the protective helmet 1, although this is not depicted. This can be as a consequence of circumferential angular rotation between the outer shell 2 and the inner shell 3 (i.e. during an impact the outer shell 2 can be rotated by a circumferential angle relative to the inner shell 3).

Figure 3A:
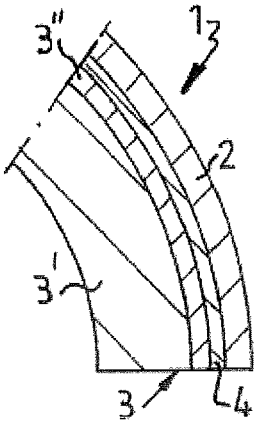
FIGS. 3A, 3B & 3C show variations of the structure of the helmet of FIG. 1.
Figure 3B:
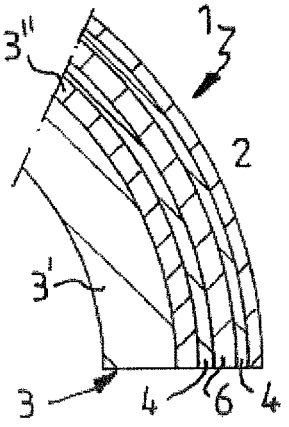
Figure 3C:
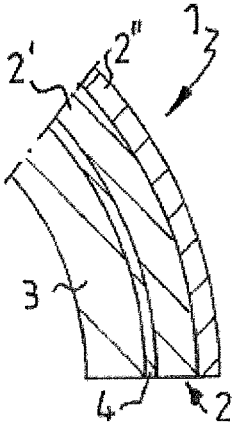

Other arrangements of the protective helmet 1 are also possible. A few possible variants are shown in FIG. 3. In FIG. 3*a*, the inner shell 3 is constructed from a relatively thin outer layer 3" and a relatively thick inner layer 3'. The outer layer 3" is preferably harder than the inner layer 3', to help facilitate the sliding with respect to outer shell 2. In FIG. 3*b*, the inner shell 3 is constructed in the same manner as in FIG. 3*a*. In this case, however, there are two sliding layers 4, between which there is an intermediate shell 6. The two sliding layers 4 can, if so desired, be embodied differently and made of different materials. One possibility, for example, is to have lower friction in the outer sliding layer than in the inner. In FIG. 3*c*, the outer shell 2 is embodied differently from previously. In this case, a harder outer layer 2" covers a softer inner layer 2'. The inner layer 2' may, for example, be the same material as the inner shell 3.

FIG. 4 depicts a second helmet 1 of the sort discussed in WO 2011/139224, which is also intended for providing protection against oblique impacts. This type of helmet could also be any of the types of helmet discussed above.

In FIG. 4, helmet 1 comprises an energy absorbing layer 3, similar to the inner shell 3 of the helmet of FIG. 1. The outer surface of the energy absorbing layer 3 may be provided from the same material as the energy absorbing layer 3 (i.e. there may be no additional outer shell), or the outer surface could be a rigid shell 2 (see FIG. 5) equivalent to the outer shell 2 of the helmet shown in FIG. 1. In that case, the rigid shell 2 may be made from a different material than the energy absorbing layer 3. The helmet 1 of FIG. 4 has a plurality of vents 7, which are optional, extending through both the energy absorbing layer 3 and the outer shell 2, thereby allowing airflow through the helmet 1.

An attachment device 13 is provided, for attachment of the helmet 1 to a wearer's head. As previously discussed, this may be desirable when energy absorbing layer 3 and rigid shell 2 cannot be adjusted in size, as it allows for the different size heads to be accommodated by adjusting the size of the attachment device 13. The attachment device 13 could be made of an elastic or semi-elastic polymer material, such as PC, ABS, PVC or PTFE, or a natural fibre material such as cotton cloth. For example, a cap of textile or a net could form the attachment device 13.

Although the attachment device 13 is shown as comprising a headband portion with further strap portions extending from the front, back, left and right sides, the particular configuration of the attachment device 13 can vary according to the configuration of the helmet. In some cases the attachment device may be more like a continuous (shaped) sheet, perhaps with holes or gaps, e.g. corresponding to the positions of vents 7, to allow air-flow through the helmet.

FIG. 4 also depicts an optional adjustment device 6 for adjusting the diameter of the head band of the attachment device 13 for the particular wearer. In other arrangements, the head band could be an elastic head band in which case the adjustment device 6 could be excluded.

A sliding facilitator 4 is provided radially inwards of the energy absorbing layer 3. The sliding facilitator 4 is adapted to slide against the energy absorbing layer or against the attachment device 13 that is provided for attaching the helmet to a wearer's head.

The sliding facilitator 4 is provided to assist sliding of the energy absorbing layer 3 in relation to an attachment device 13, in the same manner as discussed above. The sliding facilitator 4 may be a material having a low coefficient of friction, or may be coated with such a material.

As such, in the FIG. 4 helmet, the sliding facilitator may be provided on or integrated with the innermost side of the energy absorbing layer 3, facing the attachment device 13.

However, it is equally conceivable that the sliding facilitator 4 may be provided on or integrated with the outer surface of the attachment device 13, for the same purpose of providing slidability between the energy absorbing layer 3 and the attachment device 13. That is, in particular arrangements, the attachment device 13 itself can be adapted to act as a sliding facilitator 4 and may comprise a low friction material.

In other words, the sliding facilitator 4 is provided radially inwards of the energy absorbing layer 3. The sliding facilitator can also be provided radially outwards of the attachment device 13.

When the attachment device 13 is formed as a cap or net (as discussed above), sliding facilitators 4 may be provided as patches of low friction material.

The low friction material may be a waxy polymer, such as PTFE, ABS, PVC, PC, Nylon, PFA, FEP, PE and UHMWPE, or a powder material which could be infused with a lubricant. The low friction material could be a fabric material. As discussed, this low friction material could be applied to either one, or both of the sliding facilitator and the energy absorbing layer.

The attachment device 13 can be fixed to the energy absorbing layer 3 and/or the outer shell 2 by means of fixing members 5, such as the four fixing members 5*a*, 5*b*, 5*c* and 5*d* in FIG. 4. These may be adapted to absorb energy by deforming in an elastic, semi-elastic or plastic way. However, this is not essential. Further, even where this feature is present, the amount of energy absorbed is usually minimal in comparison to the energy absorbed by the energy absorbing layer 3 during an impact.

According to the arrangement shown in FIG. 4 the four fixing members 5*a*, 5*b*, 5*c* and 5*d* are suspension members 5*a*, 5*b*, 5*c*, 5*d*, having first and second portions 8, 9, wherein the first portions 8 of the suspension members 5*a*, 5*b*, 5*c*, 5*d* are adapted to be fixed to the attachment device 13, and the second portions 9 of the suspension members 5*a*, 5*b*, 5*c*, 5*d* are adapted to be fixed to the energy absorbing layer 3.

FIG. 5 shows an arrangement of a helmet similar to the helmet in FIG. 4, when placed on a wearer's head. The helmet 1 of FIG. 5 comprises a hard outer shell 2 made from a different material than the energy absorbing layer 3. In contrast to FIG. 4, in FIG. 5 the attachment device 13 is fixed to the energy absorbing layer 3 by means of two fixing members 5*a*, 5*b*, which are adapted to absorb energy and forces elastically, semi-elastically or plastically.

A frontal oblique impact I creating a rotational force to the helmet is shown in FIG. 5. The oblique impact I causes the energy absorbing layer 3 to slide in relation to the attachment device 13. The attachment device 13 is fixed to the energy absorbing layer 3 by means of the fixing members 5*a*, 5*b*. Although only two such fixing members are shown, for the sake of clarity, in practice many such fixing members may be present. The fixing members 5 can absorb the rotational forces by deforming elastically or semi-elastically. In other arrangements, the deformation may be plastic, even resulting in the severing of one or more of the fixing members 5. In the case of plastic deformation, at least the fixing members 5 will need to be replaced after an impact. In some case a combination of plastic and elastic deformation in the fixing members 5 may occur, i.e. some fixing members 5 rupture, absorbing energy plastically, whilst other fixing members deform and absorb forces elastically.

In general, in the helmets of FIG. 4 and FIG. 5, during an impact the energy absorbing layer 3 acts as an impact absorber by compressing, in the same way as the inner shell of the FIG. 1 helmet. If an outer shell 2 is used, it will help spread out the impact energy over the energy absorbing layer 3. The sliding facilitator 4 will also allow sliding between the attachment device and the energy absorbing layer. This allows for a controlled way to dissipate energy that would otherwise be transmitted as rotational energy to the brain. The energy can be dissipated by friction heat, energy absorbing layer deformation or deformation or displacement of the fixing members. The reduced energy transmission results in reduced rotational acceleration affecting the brain, thus reducing the rotation of the brain within the skull. The risk of rotational injuries including MTBI and STBI such as subdural haematomas, SDH, blood vessel rapturing, concussions and DAI is thereby reduced.

Connectors that may be used within a helmet are described below. It should be appreciated that these connectors may be used in a variety of contexts and are not to be limited to use within helmets. For example, they may be used in other devices that provide impact protection, such as body armour or padding for sports equipment. In the context of helmets, the connectors may, in particular, be used in place of the previously known connecting members and/or fixing members of the arrangements discussed above.

Figure 6:
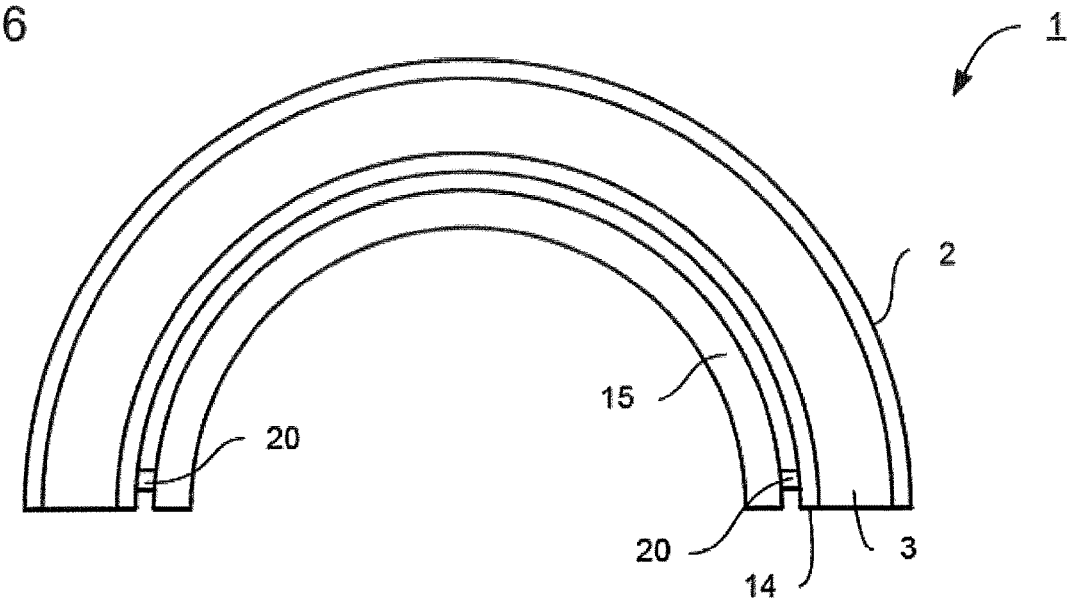

In an arrangement, the connector may be used with a helmet 1 of the type shown in FIG. 6. The helmet shown in FIG. 6 has a similar configuration to that discussed above in respect of FIGS. 4 and 5. In particular, the helmet has a relatively hard outer shell 2 and an energy absorbing layer 3. A head attachment device is provided in the form of a helmet liner 15. The liner 15 may include comfort padding as discussed above. In general, the liner 15 and/or any comfort padding may not absorb a significant proportion of the energy of an impact in comparison with the energy absorbed by the energy absorbing layer 3.

The liner 15 may be removable. This may enable the liner to be cleaned and/or may enable the provision of liners that are modified to fit a specific wearer.

Between the liner 15 and the energy absorbing layer 3, there is provided an inner shell 14 formed from a relatively hard material, namely a material that is harder than the energy absorbing layer 3. The inner shell 14 may be moulded to the energy absorbing layer 3 and may be made from any of the materials discussed above in connection with the formation of the outer shell 2.

In the arrangement of FIG. 6, a low friction interface is provided between the inner shell 14 and the liner 15. This may be implemented by the appropriate selection of at least one of the material used to form the outer surface of the liner 15 or the material used to form the inner shell 14. Alternatively or additionally, a low friction coating may be applied to at least one of the opposing surfaces of the inner shell 14 and the liner 15. Alternatively or additionally, a lubricant may be applied to at least one of the opposing surfaces of the inner shell 14 and the liner 15.

As shown, the liner 15 may be connected to the remainder of the helmet 1 by way of one or more connectors 20, discussed in further detail below. Selection of the location of the connectors 20 and the number of connectors 20 to use may depend upon the configuration of the remainder of the helmet.

In an arrangement such as shown in FIG. 6, at least one connector 20 may be connected to the inner shell 14. Alternatively or additionally, one or more of the connectors 20 may be connected to another part of the remainder of the helmet 1, such as the energy absorbing layer 3 and/or the outer shell 2. The connectors 20 may also be connected to two or more parts of the remainder of the helmet 1.

Figure 7:
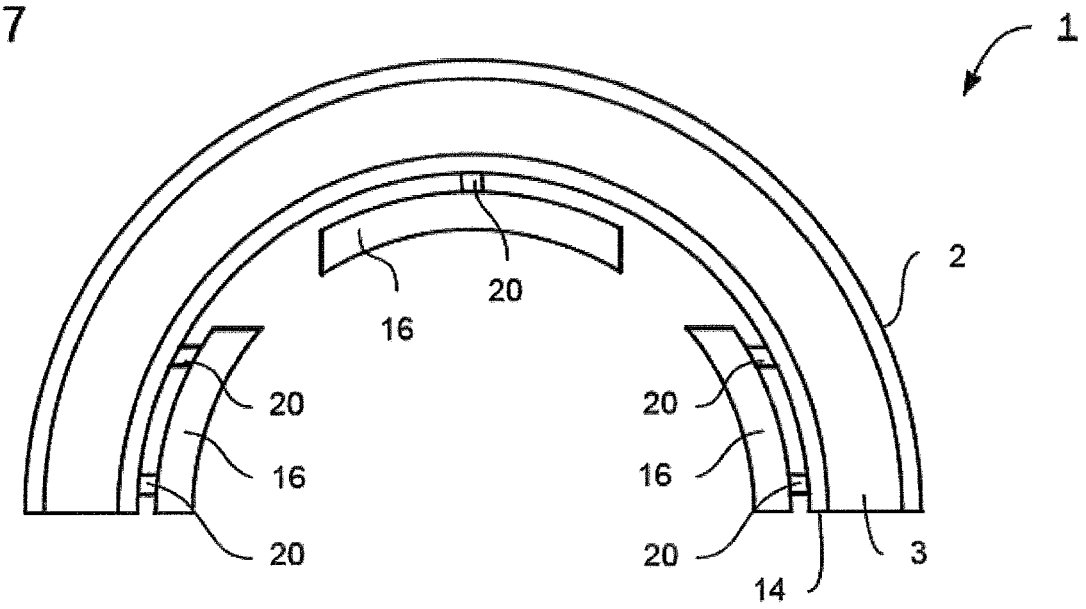

FIG. 7 depicts a further alternative arrangement of a helmet 1. As shown, the helmet 1 of this arrangement includes a plurality of independent sections of comfort padding 16. Each section of comfort padding 16 may be connected to the remainder of the helmet by one or more connectors 20.

The sections of comfort padding 16 may have a sliding interface provided between the sections of comfort padding 16 and the remainder of the helmet 1. In such an arrangement, the sections of comfort padding 16 may provide a similar function to that of the liner 15 of the arrangement shown in FIG. 6. The options discussed above for provision of a sliding interface between a liner and a helmet also apply to the sliding interface between the sections of comfort padding and the helmet.

It should also be appreciated that the arrangement of FIG. 7, namely the provision of a plurality of independently mounted sections of comfort padding 16 provided with a sliding interface between the sections of comfort padding 16 and the remainder of the helmet, may be combined with any form of helmet, including those such as depicted in FIGS. 1 to 5 that also have a sliding interface provided between two other parts of the helmet.

Possible arrangements of connectors 20 will now be described. For convenience, the connectors 20 will be described in the context of a connector for connecting a liner 15 to the remainder of a helmet 1 as depicted in FIG. 6. However, it should be appreciated that the connector 20 may be used for connecting any two parts of an apparatus together. Furthermore, where below the connector 20 is described as having a first component connected to a first part of an apparatus, such as a helmet liner 15, and a second component connected to a second part of an apparatus, such as the remainder of the helmet 1, it should be appreciated that, with suitable modifications, this may be reversed.

Figure 8:
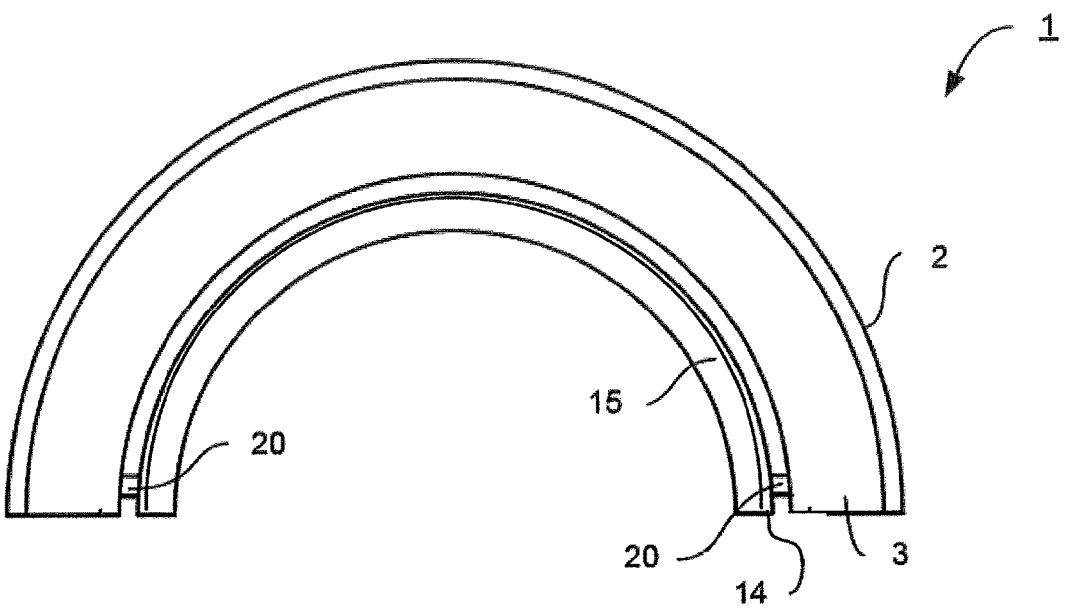
Figure 9:
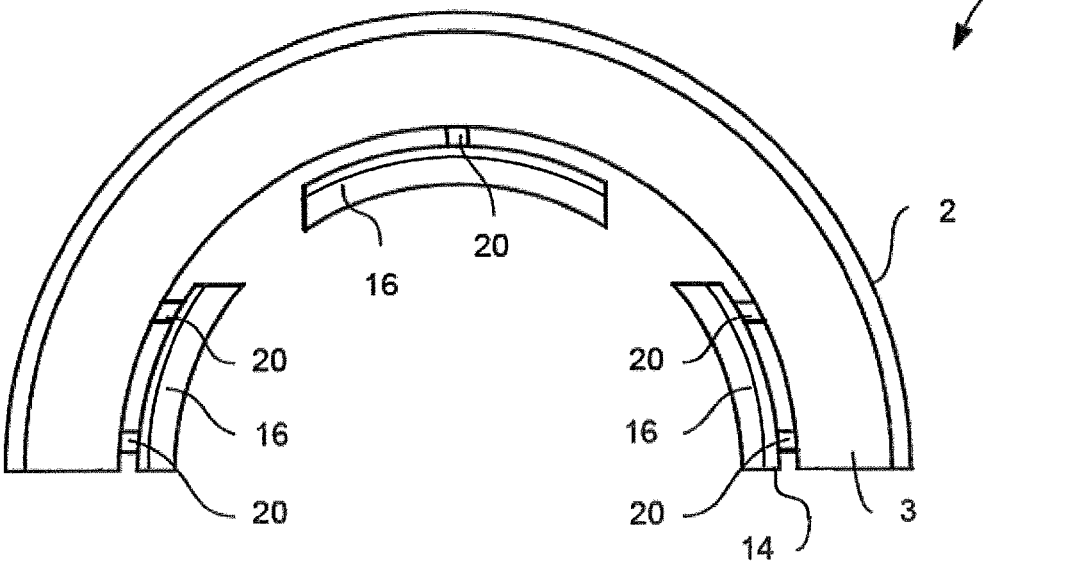

FIGS. 8 and 9 show equivalent arrangements to those of FIGS. 6 and 7, except that the inner shell 14 is applied to the liner 15 (in FIG. 8) or comfort padding 16 (in FIG. 9). In the case of FIG. 9, the inner shell 14 may only be a partial shell or a plurality of sections of shell, as compared to the substantially full shell arrangements of FIGS. 6 to 8. Indeed, in both FIGS. 8 and 9 the inner shell 14 may also be characterised as a relatively hard coating on the liner 15 or comfort padding 16. As for FIGS. 6 and 7, the inner shell 14 is formed from a relatively hard material, namely a material that is harder than the energy absorbing layer 3. For example, the material could be PTFE, ABS, PVC, PC, Nylon, PFA, FEP, PE and UHMWPE. The material may be bonded to the outer side of the liner 15 or comfort padding 16 to simplify the manufacturing process. Such bonding could be through any means, such as by adhesive or by high frequency welding.

In FIGS. 8 and 9 a low friction interface is provided between the inner shell 14 and the energy absorbing layer 3. This may be implemented by the appropriate selection of at least one of the material used to form the outer surface of the energy absorbing layer 3 or the material used to form the inner shell 14. Alternatively or additionally, a low friction coating may be applied to at least one of the opposing surfaces of the inner shell 14 and the energy absorbing layer 3. Alternatively or additionally, a lubricant may be applied to at least one of the opposing surfaces of the inner shell 14 and the energy absorbing layer 3.

In FIGS. 8 and 9, at least one connector 20 may be connected to the inner shell 14. Alternatively or additionally, one or more of the connectors 20 may be connected to another part of the remainder of the liner 15 or comfort padding 16.

FIGS. 10, 11 and 12 respectively depict, a top view, a bottom view and a side view in cross-section (through the dashed lines in FIG. 10), of a connector 20 that may be used to connect first and second parts of an apparatus, such as a helmet. In particular it may be configured to connect a liner 15 or comfort padding 16 to the remainder of a helmet.

In the arrangement depicted in FIG. 10, the connector 20 includes an inner region 21, and two arms 22 extending outward from an edge of the inner region 21. In the arrangement shown in FIGS. 10 and 11, the inner region 21 is substantially circular in shape as viewed from above. However, the inner region 21 is not limited to this shape. Any shape could be used instead, e.g. substantially square or substantially rectangular (with sharp or rounded corners), substantially elliptical or substantially oval.

The inner region 21 comprises an anchor point 23 (referred to as a "first" anchor point) on a first side thereof configured to connect the connector 20 to the first part of the apparatus. The first anchor point 23 is depicted in FIG. 10 in the form of a point at which one side of a hook and loop connector is attached (the other side being on the first part of the apparatus, e.g. a helmet). However, other methods of "detachable" attachment may be used, such as a snap-fit connection or a magnetic connector. Other forms of detachable connection may also be used.

Alternatively, the first anchor point 23 may be used for permanent attachment. For example, the first anchor point 23 may be in the form of a point at which the inner region 21 is attached by high frequency welding to the first part of the apparatus. However, other methods of 'permanent' or non-releasable attachment may be used, such using an adhesive or stitching.

Either type of attachment (detachable or permanent) may be configured such that it prevents translational movement of a first anchor point 23 relative to the part being connected to. However, it may be configured such that the first anchor point 23 and therefore the inner region 21 can rotate about one or more axes of rotation relative to the part being connected to. Alternatively or additionally, the first anchor point 23 may be connected to the parts to be connected by way of one or more additional components.

When viewed in plan view, the first anchor point 23 may be arranged substantially at the centre of the inner region 21. However, this is not essential.

The inner region 21 further comprises a sliding surface **24*a* on a second side thereof, opposite the first side, the sliding surface 24*a* being configured to provide a low friction interface between the inner region 21** and an opposing surface of the second part of the apparatus.

FIG. 13 shows an example in which a layer of comfort padding 16 comprises a plurality of the connectors 20 depicted in FIGS. 10 to 12. In the arrangement depicted in FIG. 13, the sliding surface **24*a* of the connector 20 is provided adjacent to the surface of the second part, in this case the comfort padding layer 16, such that the sliding surface 24*a* may slide on the surface of the comfort padding layer 16 (e.g. translationally and/or rotationally with respect to a neutral position of the inner region 21**).

In order to ensure that the sliding surface **24*a* can slide relative to the surface of the second part of the apparatus, a low friction interface may be provided between the opposing surfaces of the sliding surface 24*a*** and the second part of the apparatus.

In this context, a low friction interface may be configured such that sliding contact is still possible even under the loading that may be expected in use. In the context of a helmet, for example, it may be desirable for sliding to be maintained in the event of an impact that is expected to be survivable for the wearer of a helmet. This may be provided, for example, by the provision of an interface between the two surfaces at which the coefficient of friction is between 0.001 and 0.3 and/or below 0.15.

A low friction interface may be implemented by at least one of using at least one low friction material for the construction of the element forming at least one of the opposing surfaces of the sliding surface and the surface of the second part of the apparatus, applying a low friction coating to at least one of the opposing surfaces, applying a lubricant to at least one of the opposing surfaces, and providing an unsecured additional layer of material between the opposing surfaces that has at least one low friction surface.

In the arrangement shown in FIGS. 10 to 12, the inner region 21 comprises a portion of deformable material integrally formed with the arms 22 and a plate 24 of relatively stiff material compared to the deformable material. The plate 24 may be formed from a sufficiently stiff material that the plate 24 (and therefore, at least part of the inner region 21) substantially retains its shape during expected use of the apparatus. In the context of a helmet, this may include normal handling of the helmet and wearing the helmet under normal conditions. It may also include conditions including an impact on the helmet for which the helmet is designed with the expectation that the impact would be survivable for the wearer of the helmet.

The plate 24 may be made from a variety of different materials. In an example, the plate 24 may be made from polycarbonate (PC), polyvinylchloride (PVC), acrylonitrile butadiene styrene (ABS), polypropylene (PP), Nylon or another plastic. The plate may optionally have a thickness in the range of from approximately 0.2 mm to approximately 1.5 mm, for example approximately 0.7 mm thick.

The plate 24 may be substantially the same shape as the inner region as viewed in plan view. The deformable material of the inner region 21 may partially cover the plate 24 on one side. In the arrangement shown in FIGS. 10 to 12, the deformable material of the inner region 21 is ring shaped (annular) so as to cover one side of the periphery of the circular plate 24. The ring shape defines a circular through-hole in the deformable material. This through-hole allows the anchor point 23 to be directly connected to the plate 24, as shown in FIG. 12.

Other arrangements may be possible, however. For example, the deformable material may completely cover one side of the plate 24 (i.e. no through-hole is provided), in which case the anchor point 23 may be connected to the deformable material. Further, the deformable material of the inner region 21 may at least partially cover two opposing sides of the plate 24.

The plate 24 may be fixed to the deformable material by an adhesive, for example. Alternatively, the plate 24 may be co-moulded with the deformable material of the inner region 21. However, in some arrangements, the plate 24 may not be fixed to the deformable material. For example, with reference to FIG. 12, the anchor point 23 may be wider than the through-hole in the deformable material (or provided on a second plate wider than the through-hole) and located on the other side of the deformable material to the plate 24. The anchor point 23 and the plate 24 may be connected via the through-hole so as to sandwich the deformable material therebetween.

The arms 22 of the connector 20 are formed from a deformable material and configured to connect the connector 20 to the second part of the apparatus. In the arrangement of FIGS. 10 to 12, the arms 22 extend from mutually opposite sides of the inner region 21. However, other arrangements are possible instead. Further, the connector 20 is not limited to having two arms 22. For example, three, four, or more arms 22 may be provided. The arms may be arranged symmetrically, for example, (e.g. at regular intervals around the edge of the inner region 21).

As shown in FIGS. 10 to 12, each arm 22 may extend in a direction substantially parallel to the sliding surface 24*a* of the inner region 21. However, other arrangements may be possible. For example, the arms 22 may extend at an angle to the siding surface 24*a* of the inner region 21. In that case, the arms 22 may extend in away from the inner region 21 towards the side of the connector 20 on which the anchor point 23 is provided or towards a side of the connector 20 on which the sliding surface 24*a* is provided.

In the arrangement shown in FIGS. 10 to 12, each arm 22 may further comprise an anchor point 25 (referred to as a "second" anchor point to distinguish from the first anchor point 23 of the inner region 21) for connecting the arm 22 to the second part of the apparatus. The second anchor point 25 may be located at a distal end of each arm 22, as indicated in FIG. 11.

The second anchor point 25 may be used for permanent attachment. For example, the anchor point 25 may be in the form of a point at which the arms 22 are attached by adhesive to the first part of the apparatus. The arms 22 may include a groove or ridge running substantially perpendicular to the extension direction of the arms 22 to provide a barrier to prevent adhesive spreading from the distal end of the arms 22 towards the inner region. Other methods of 'permanent' or non-releasable attachment may alternatively be used, such as using high frequency welding or stitching.

Alternatively, the second anchor point 25 may be in the form of a detachable anchor point, e.g. point at which one side of a hook and loop connector is attached (the other side being on the second part of the apparatus). However, other methods of 'detachable' attachment may be used, such as a snap-fit connection or a magnetic connector.

FIG. 13 depicts a comfort padding layer 16 comprising a plurality of the connectors 20 depicted in FIGS. 10 to 12. Although the comfort padding layer 16 is shown as being flat, i.e. in the plane of the page, when the layer 16 is positioned within the rest of the helmet, the comfort padding layer 16 bends to conform to the concave shape of the inner surface of the rest of the helmet.

The arms 22 of the connectors 20 are configured to be connected to surface of the second part of the apparatus forming the sliding interface with the sliding surface of the inner region 21, so as to be substantially parallel with said surface of the second part of the apparatus, as shown in FIG. 13. However, other arrangements are possible. For example, the arms 22 may be arranged to wrap around a portion of the second part of the apparatus and attach to a surface of the second part of the apparatus opposite the surface forming the sliding interface. This arrangement is similar to that described below in relation to FIG. 17.

When attached to the second part of the apparatus, the arms 22, formed from the deformable material, are configured to bias the inner region 21 towards a first position, such that when the inner region 21 is displaced away from the first position (e.g. by sliding along a low friction interface) the arms 22 of deformable material urge the inner region 21 back into the first position.

As the sliding surface 24*a* of the connector 20 slides over the surface of the second part of apparatus (e.g. during an impact), the inner region 21 moves relative to the surface of the second part of the apparatus and deforms the arms 22. As such, the arms 22 define a (neutral) natural resting position of the inner region 21 relative to the first and second parts of the surrounding apparatus to which they connect via the anchor points 23, 25. However, by deformation of the deformable material 23 during displacement of the inner region 21, for example stretching of one side of the deformable material, the inner region 21 is permitted to slide. In doing so, the first part of the apparatus, such as the remainder of the helmet, which may be connected to the first anchor point 23, may slide relative to the first part of the apparatus, such as the liner 15, connected to the second anchor point 25.

A connector 20 may be configured to permit a desired relative range of movement of the inner region 21, and therefore the relative range of movement between the first part of the apparatus the second part of the apparatus being connected. Such configuration may be achieved by the selection of the material forming the arms 22, the thickness of the material forming the arms 22 and the number and location of the arms 22. For example, a connector 20 for use within a helmet may be configured to enable a relative movement of the inner region 21 to the surface of the second part of the apparatus of approximately 5 mm or more in any direction within a plane parallel to the sliding surface of the inner region 21.

The arms 22 can be formed of material that deforms substantially elastically for the required range of movement of the inner region 21 relative to the second part of the apparatus. For example, the deformable material may be formed from at least one of an elasticated fabric, an elasticated cloth, an elasticated textile and an elastomeric material, e.g. a elastomeric polymeric material such as silicone/polysiloxane.

The deformable material may be formed as a single piece, by moulding for example, or may be formed by connecting together multiple pieces, e.g. an upper layer and a lower layer, subsequently joined.

FIGS. 14, 15 and 16 respectively depict, a top view, a bottom view and a side view in cross-section (through the dashed lines in FIG. 14), of a further arrangement of a connector 20 that may be used to connect first and second parts of an apparatus, such as a helmet. In particular it may be configured to connect a liner 15 or comfort padding 16 to the remainder of a helmet.

In the arrangement depicted in FIG. 14, the connector 20 includes an inner region 21, and two arms 22 extending outward from an edge of the inner region 21. The inner region 21 may be the same as the inner region 21 of the connector depicted in FIGS. 10 to 12. However, the arms 22 are different to the arms of that arrangement. Therefore, only the arms 22 will be described in detail below.

Similarly to the previous arrangement, the arms 22 of the connector 20 are formed from a deformable material and configured to connect the connector 20 to the second part of the apparatus. In the arrangement of FIGS. 14 to 16, the arms extend from mutually opposite sides of the inner region 21. However, other arrangements are possible instead. Further, the connector 20 is not limited to having two arms 22. For example, four, or more arms 22 may be provided. The arms, may be arranged symmetrically, for example, e.g. at regular intervals around the edge of the inner region 21.

As shown in FIGS. 14 to 16, each arm 22 extends away from the first anchor point and joins with the other arm 22 to form a closed loop on the opposite side of the inner region 21 to the first anchor point 23. The closed loop is configured to loop around a portion of the second part of the apparatus. The loop may be formed from a plurality of substantially straight sections, the sections being angled with respect to each other (e.g. as shown in FIG. 16) and/or may be formed from one or more curved sections.

In the arrangement shown in FIGS. 14 to 16, the arms 22 may further comprise an anchor point 25 (referred to as a "second" anchor point to distinguish from the first anchor point 23 of the inner region) for connecting the arms 22 to the second part of the apparatus. The connector 20 may have only one second anchor point 25.

The second anchor point 25 may be arranged on the loop formed by the arms 22 at a location opposite and facing the inner region 21 and may be configured to connect to a surface of the second part of the apparatus opposite the surface forming the sliding interface. In other words, the connector 20 may be attached to the inside of the second part of the apparatus, the sliding interface being provided on the outside of the second part of the apparatus. As shown in FIG. 15, the arms 22 may comprise a relative wide portion at the location of the second anchor point to allow for a larger anchor point 25. This relatively wide portion may be substantially circular in shape, for example, as shown in FIG. 15.

The second anchor point 25 may be used for permanent attachment. For example, the anchor point 25 may be in the form of a point at which the arms 22 are attached by adhesive to the first part of the apparatus. The arms 22 may include grooves or ridges running substantially perpendicular to the extension direction of the arms 22 to provide a barrier to prevent adhesive spreading from the second anchor point 25 towards the inner region 21. Other methods of 'permanent' or non-releasable attachment may alternatively be used, such as using high frequency welding or stitching.

Alternatively, the second anchor point 25 may be in the form of a detachable anchor point, e.g. point at which one side of a hook and loop connector is attached (the other side being on the second part of the apparatus). However, other methods of 'detachable' attachment may be used, such as a snap-fit connection or a magnetic connector.

FIG. 17 depicts a comfort padding layer 16 comprising a plurality of the connectors 20 depicted in FIGS. 14 to 16. Although the comfort padding layer 16 is shown as being flat, i.e. in the plane of the page, when the layer 16 is positioned within the rest of the helmet, the layer 16 bends to conform to the concave shape of the inner surface of the rest of the helmet.

When attached to the second part of the apparatus, the arms 22, formed from the deformable material, are configured to bias the inner region 21 towards a first position, such that when the inner region 21 is displaced away from the first position (e.g. by sliding along a low friction interface) the arms 22 of deformable material urge the inner region 21 back into the first position.

As the sliding surface 24*a* of the connector 20 slides over the surface of the second part of apparatus (e.g. during an impact), the inner region 21 moves relative to the surface of the second part of the apparatus and deforms the arms 22. As such, the arms 22 define a (neutral) natural resting position of the inner region 21 relative to the first and second parts of the surrounding apparatus to which they connect via the anchor points 23, 25. However, by deformation of the deformable material during displacement of the inner region 21, for example stretching of one side of the deformable material, the inner region 21 is permitted to slide. In doing so, the first part of the apparatus, such as the remainder of the helmet, which may be connected to the first anchor point 23, may slide relative to the first part of the apparatus, such as the liner 15, connected to the second anchor point 25.

A connector 20 may be configured to permit a desired relative range of movement of the inner region 21, and therefore the relative range of movement between the first part of the apparatus the second part of the apparatus being connected. Such configuration may be achieved by the selection of the material forming the arms 22, the thickness of the material forming the arms 22 and the number and location of the arms 22. For example, a connector 20 for use within a helmet may be configured to enable a relative movement of the inner region 21 to the surface of the second part of the apparatus of approximately 5 mm or more in any direction within a plane parallel to the sliding surface of the inner region 21.

The arms 22 can be formed of material that deforms substantially elastically for the required range of movement of the inner region 21 relative to the second part of the apparatus. For example, the deformable material may be formed from at least one of an elasticated fabric, an elasticated cloth, an elasticated textile and an elastomeric material, e.g. an elastomeric polymeric material such as silicone/polysiloxane.

The deformable material may be formed as a single piece, by moulding for example, or may be formed by connecting together multiple pieces, e.g. an upper layer and a lower layer, subsequently joined.

FIGS. 18, 19 and 20 respectively depict, a top view, a bottom view and a side view in cross-section (through the dashed lines in FIG. 18), of a further arrangement of a connector 20 that may be used to connect first and second parts of an apparatus, such as a helmet. In particular it may be configured to connect a liner 15 or comfort padding 16 to the remainder of a helmet.

In the arrangement depicted in FIG. 18, the connector 20 includes an inner region 21, and two arms 22 extending outward from an edge of the inner region 21. The arms 22 may be substantially the same as the arms 22 of the arrangement depicted in FIGS. 14 to 16 and only the differences between the arrangements will be discussed below.

In the arrangement shown in FIGS. 18 and 19, the inner region 21 is substantially circular in shape as viewed from above. However, the inner region 21 is not limited to this shape. Any shape could be used instead, e.g. substantially square or substantially rectangular (with sharp or rounded corners), substantially elliptical or substantially oval.

The inner region 21 comprises a first anchor point 23 on a first side thereof configured to connect the connector 20 to the first part of the apparatus. The first anchor point 23 is the same as described previously in relation to FIGS. 10 to 12 and 14 to 16.

The inner region 21 further comprises a sliding surface 24*a* on a second side thereof, opposite the first side, the sliding surface 24*a* being configured to provide a low friction interface between the inner region 21 and an opposing surface of the second part of the apparatus. The sliding surface 24*a* is the same as described previously in relation to FIGS. 10 to 12 and 14 to 16.

The inner region 21 of the arrangement shown in FIGS. 18 to 20 differs from the inner region 21 of the arrangement shown in FIGS. 10 to 12 and 14 to 16 in that the inner region 21 does not comprise a portion of deformable material integrally formed with the arms 22. Instead, the inner region 21 comprises a plate 24 of relatively stiff material compared to the deformable material, connected to the arms 22.

In the arrangement shown in FIGS. 18 to 20, the plate 24 comprises protrusions 26 extending from an edge of the inner region 21 (parallel to the plate 24) and the plate 24 is connected to the arms 22 via the protrusions 26. The plate 24 may otherwise be the same as described in relation to the arrangements shown in FIGS. 10 to 12 and 14 to 16.

The deformable material of the arms 22 may at least partially cover two opposing sides of the protrusions 26. In the arrangement shown in FIGS. 18 to 20, the deformable material of the arms 22 forms a slot 27, surrounded on all sides by the deformable material, into which the protrusions 26 are inserted. Other arrangements may be possible, however. For example, the deformable material of the arms 22 may at least partially cover the protrusions 26 only on one side.

The protrusions 26 may be fixed to the deformable material of the arms 22 by an adhesive, for example, as depicted in FIG. 12. Alternatively, the protrusions 26 may be co-moulded with the deformable material of the arms 22

In yet a further arrangement, not shown in the Figures, the inner region 21 of the arrangement shown in FIGS. 18 to 20 may be combined with the arms 22 of the arrangement shown in FIGS. 10 to 12, i.e. arms extending away from the inner region 21 but not forming a closed loop.

Although in each of the specific arrangements described above the inner region comprises a relatively stiff plate 24 which provides the sliding surface 24*a*, alternative arrangements are possible. For example, the sliding surface 24*a* may be provided by a flexible material, such as a layer of fabric (woven or nonwoven). The flexible material may be exchanged, like-for-like, with the plate 24 in any of the above described arrangements. In such arrangements, the flexible material would not be provided on the surface of the arms 22. However, the flexible material may additionally be provided on the surface of the arms 22 facing the second part of the apparatus, e.g. as one continuous layer. Accordingly, the sliding interface may not only be provided between the inner region 21 and the surface of the second part of the apparatus, but also between the surface of the arms 22 and the surface of the second part of the apparatus.

The connectors 20 may be used in combination with a different type of connector to connect the first and second parts of the apparatus. For example, the connectors 20 may be used in combination with the connectors described in WO 2017/157765 or GB 1719559.5, which are herein incorporated in their entirety by reference.

As discussed above, within a helmet a sliding interface may be provided between two components of a helmet, such as between two layers or shells of a helmet and/or between two parts of a connector provided between two layers or shells of a helmet. In the context of the present invention, the term sliding interface is intended to refer to a low friction (sliding) interface. Such a sliding interface may be provided by forming at least one of the components from materials selected such that there is low friction when their surfaces are in contact, namely at the sliding surfaces. The components need not be formed from the same material. Also, there is no particular limitation on the location of the sliding interface—for instance, in the above mentioned first arrangement, it is noted that in one embodiment the sliding interface may be provided between the first and second layers of said first arrangement.

It has been found that the performance of the sliding interface may be enhanced when (at least) one of the components (e.g. the first component) comprises (a) a mixture of (i) an olefin polymer, (ii) a lubricant, and optionally one or more further agents; or (b) an ultra high molecular weight (UHMW) polymer having a density of ≤960 kg/m$^3$, which UHMW polymer is preferably an olefin polymer. It should be appreciated that any of the sliding interfaces discussed above may comprise such a mixture or UHMW polymer.

Option (a) for the First Component

In option (a), the first component comprises a mixture of (i) an olefin polymer, (ii) a lubricant, and optionally one or more further agents.

The olefin polymer may be a homopolymer or a copolymer (i.e. a polymer derived from two or more species of monomer). Preferably, it is a copolymer.

The olefin polymer preferably comprises straight or branched alkylene units having 2 to 6 carbon atoms, such as ethylene, propylene, butylene, pentylene and/or hexylene. More preferably, the straight or branched alkylene units have 2 to 5 carbon atoms, more preferably still 2 to 4 carbon atoms, and most preferably 2 or 3 carbon atoms (i.e. most preferably they are ethylene and/or propylene). Typically, the olefin polymer comprises alkylene units having 2 carbon atoms and/or alkylene units having 3 carbon atoms, Thus, in one embodiment, the olefin polymer comprises alkylene units having 2 carbon atoms whereas in another embodiment the olefin polymer comprises alkylene units having 3 carbon atoms. In a more preferred embodiment, the olefin polymer comprises alkylene units having 2 carbon atoms and alkylene units having 3 carbon atoms.

Thus, the olefin polymer preferably comprises ethylene and/or propylene units. More preferably it is a polymer comprising propylene units. For instance, it may be a propylene copolymer or a propylene homopolymer. More preferably it is a copolymer (typically a polypropylene copolymer—i.e. a copolymer comprising multiple propylene units plus units from one or more further olefin such as ethylene). More preferably still it is a random copolymer (typically a polypropylene random copolymer, such as a random ethylene-propylene copolymer).

The olefin polymer is preferably a copolymer comprising propylene and/or ethylene units. Yet more preferably it is a copolymer comprising propylene units, i.e. a propylene copolymer. Yet more preferably it is a copolymer comprising ethylene and propylene units. Yet more preferably it is a random copolymer comprising ethylene and propylene units. In particular, it may be a random copolymer consisting substantially of ethylene and propylene units.

Preferably, propylene units account for at least 50% by weight of the polymer (in this regard, all references to % herein are generally intended to refer to % by weight unless indicated otherwise). More preferably the propylene units account for a higher proportion, such as at least 60%, at least 70%, at least 80%, at least 85%, at least 88%, at least 90%, at least 91%, at least 92%, or at least 93% by weight. The propylene units account for substantially all of the weight of the polymer when the polymer is a homopolymer. When the polymer is a copolymer, propylene units preferably account for up to 99.5% by weight of the polymer, such as up to 99.0%, up to 98.5% or up to 98.0% by weight of the polymer.

Thus, the olefin polymer is preferably obtainable by polymerising one or more monomer materials, wherein propene accounts for at least 50% (such as at least 60%, at least 70%, at least 80%, at least 85%, at least 88%, at least 90%, at least 91%, at least 92%, or at least 93%) by weight of said one or monomer materials. Propene may account for substantially all of said one or monomer materials when the polymer is a homopolymer. When the polymer is a copolymer, propene preferably accounts for up to 99.5% by weight of said one or monomer materials, such as up to 99.0%, up to 98.5% or up to 98.0%.

When the olefin polymer is a copolymer, ethylene units may account for up to 50% by weight of the polymer, such as up to 40%, up to 30%, up to 20%, up to 15%, up to 12%, up to 10%, up to 9%, up to 8% or up to 7% by weight. Ethylene units may account for at least 0.5% by weight of the polymer, such as at least 1.0%, at least 1.5%, or at least 2.0% by weight. Thus, the olefin polymer is preferably obtainable by polymerising one or more monomer materials, wherein ethene accounts for up to 50% (such as up to 40%, up to 30%, up to 20%, up to 15%, up to 12%, up to 10%, up to 9%, up to 8% or up to 7%) by weight of said one or monomer materials. Ethene may account for at least 0.5% by weight of said one or monomer materials, such as at least 1.0%, at least 1.5%, or at least 2.0% by weight.

For instance, in one embodiment, propylene units account for 85 to 99.5% by weight of the olefin polymer (preferably 93 to 99.0% by weight) and ethylene units account for 0.5 to 15% by weight of the olefin polymer (preferably 1.0 to 7% by weight). Or, the olefin polymer is obtainable by polymerising 85 to 99.5% by weight (preferably 93 to 99.0% by weight) of propene and 0.5 to 15% by weight (preferably 1.0 to 7% by weight) of ethene.

Preferably, the olefin polymer is composed primarily of propylene and ethylene units. Thus, ethylene and propylene units preferably account for at least 80% by weight of the olefin polymer (and/or the mixture of monomer materials which are polymerised), such as at least 85%, at least 90%, at least 95%, at least 97%, at least 98% or at least 99% by weight. Typically the olefin polymer is an ethylene-propylene copolymer. Preferably it is an ethylene-propylene random copolymer.

In one preferred embodiment, the olefin polymer is an ethylene-propylene copolymer (typically a random copolymer) wherein propylene units account for 85 to 99.5% by weight of the copolymer (preferably 93 to 99.0% by weight) and ethylene units account for 0.5 to 15% by weight of the olefin polymer (preferably 1.0 to 7% by weight). Thus, the olefin polymer is preferably an ethylene-propylene copolymer (typically a random copolymer) obtainable by polymerising 85 to 99.5% by weight (preferably 93 to 99.0% by weight) of propylene and 0.5 to 15% by weight (preferably 1.0 to 7% by weight) of ethane.

The olefin polymer may have a melting point of at least 100° C., such as at least 120° C., at least 125° C., at least 128° C., at least 130° C., at least 132° C., at least 134° C., or at least 136° C.

The olefin polymer may have a melting point of 190° C. or less, such as 170° C. or less, 165° C. or less, 160° C. or less, 158° C. or less, 156° C. or less, 154° C. or less, or 152° C. or less.

Thus, the olefin polymer may have a melting point of 130 to 160° C., such as 134 to 154° C., or 136 to 152° C.

Suitable olefin polymers are known and commercially available. One suitable example is the polypropylene random copolymer sold as Cosmoplene W531L by tpc.

In the context of the present invention, the term lubricant may refer to an additive which increases the flowability of the olefin polymer. Thus, the lubricant may improve the melt flow of the olefin polymer by lowering its viscosity and/or heat dissipation.

The lubricant is preferably organic, i.e. it is a compound that contains carbon. Typically the lubricant is has a low halogen content, such as ≤1 wt %, or ≤0.1 wt %, and more typically it is essentially halogen-free. Preferably it is a hydrocarbon, i.e. it consists essentially of only carbon and hydrogen atoms.

The lubricant is preferably a polymeric substance, i.e. preferably the lubricant is a polymer, such as polyethylene. Typically it is a polyethylene homopolymer.

The lubricant is preferably a wax. Thus, preferably the lubricant is a polymeric wax, i.e. the wax is a polymer such as polyethylene wax. More preferably it is a polyethylene homopolymer wax.

The lubricant polymer preferably has a density as measured according to ASTM D1505 of at least 0.85 g/cm$^3$, such as at least 0.86 g/cm$^3$, at least 0.87 g/cm$^3$, at least 0.88 g/cm$^3$, at least 0.89 g/cm$^3$, at least 0.90 g/cm$^3$, or at least 0.91 g/cm$^3$.

In a particularly preferred embodiment, the lubricant has a density as measured according to ASTM D1505 of less than 2.0 g/cm$^3$.

The lubricant polymer preferably has a density as measured according to ASTM D1505 of 1.99 g/cm$^3$ or less, such as 1.90 g/cm$^3$ or less, 1.80 g/cm$^3$ or less, 1.70 g/cm$^3$ or less, 1.60 g/cm$^3$ or less, 1.50 g/cm$^3$ or less, 1.40 g/cm$^3$ or less, 1.30 g/cm$^3$ or less, 1.20 g/cm$^3$ or less, 1.10 g/cm$^3$ or less, 1.00 g/cm$^3$ or less, 0.99 g/cm$^3$ or less, 0.98 g/cm$^3$ or less, 0.97 g/cm$^3$ or less, 0.96 g/cm$^3$ or less, 0.95 g/cm$^3$ or less, 0.94 g/cm$^3$ or less, or 0.93 g/cm$^3$ or less.

Thus, the lubricant polymer may have a density as measured according to ASTM D1505 of 0.88 to 1.90 g/cm$^3$, such as 0.88 to 1.50 g/cm$^3$, 0.88 to 1.20 g/cm$^3$, 0.88 to 1.10 g/cm$^3$, 0.88 to 1.00 g/cm$^3$, 0.89 to 0.95 g/cm$^3$, 0.90 to 0.94 g/cm$^3$, or 0.91 to 0.93 g/cm$^3$.

The lubricant polymer preferably has a dropping point as measured according to ASTM D3954 of at least 90° C., such as at least 95° C., at least 100° C., at least 103° C., at least 105° C., at least 106° C., at least 107° C., or at least 108° C.

The lubricant polymer preferably has a dropping point as measured according to ASTM D3954 of 130° C. or less, such as 125° C. or less, 120° C. or less, 117° C. or less, 115° C. or less, 114° C. or less, 113° C. or less, or 112° C. or less.

Thus, the lubricant polymer preferably has a dropping point as measured according to ASTM D3954 of 100 to 120° C., such as 106 to 114° C., or 108 to 112° C.

The lubricant polymer preferably has a viscosity at 149° C. as measured according to ASTM D3236 of at least 4.0 cP, such as at least 4.5 cP, at least 4.8 cP, at least 5.0 cP, at least 5.2 cP, at least 5.4 cP, at least 5.5 cP, or at least 5.6 cP.

The lubricant polymer preferably has a viscosity at 149° C. as measured according to ASTM D3236 of 40 cP or less, such as 35 cP or less, 30 cP or less, 28 cP or less, 26 cP or less, 24 cP or less, 22 cP or less, 21 cP or less, or 20 cP or less.

Thus, the lubricant polymer preferably has a dropping point as measured according to ASTM D3954 of 4.0 to 40 cP, such as 5.0 to 24 cP, or 5.6 to 20 cP.

The lubricant polymer preferably has a penetration index as measured according to ASTM D1321 of at least 0.5, such as at least 0.8, at least 1.0, at least 1.1, at least 1.2, at least 1.3, at least 1.4, or at least 1.5.

The lubricant polymer preferably has a penetration index as measured according to ASTM D1321 of 10 or less, such as 8 or less, 6 or less, 5 or less, 4 or less, 3.5 or less, 3.0 or less, 2.7 or less, or 2.5 or less.

Thus, the lubricant polymer preferably has penetration index as measured according to ASTM D1321 of 0.5 to 10, such as 1.0 to 5, or 1.5 to 2.5.

Suitable lubricants are known and commercially available. One suitable example is the polyethylene homopolymer wax sold as LP0020P by SCG Chemicals.

The first component preferably comprises the olefin polymer in an amount of at least 50% by weight, such as at least 55%, at least 60%, at least 65%, at least 70%, at least 75% or at least 80% by weight.

The first component preferably comprises the olefin polymer in an amount of up to 98% by weight, such as up to 97%, up to 96%, up to 95%, up to 94%, up to 93%, up to 92%, up to 91% or up to 90% by weight.

Thus, the first component preferably comprises the olefin polymer in an amount of 50 to 98% by weight, such as 70 to 95% by weight, or 80 to 90% by weight.

The first component preferably comprises the lubricant in an amount of at least 2% by weight, such as at least 3%, at least 4%, at least 5%, at least 6%, at least 7%, at least 8%, at least 9% or at least 10% by weight.

The first component preferably comprises the lubricant in an amount of up to 50% by weight, such as up to 45%, up to 40%, up to 35%, up to 30%, up to 25% or up to 20% by weight.

Thus, the first component preferably comprises the lubricant in an amount of 2 to 50% by weight, such as 4 to 40% by weight, or 10 to 20% by weight.

The first component may also comprise further optional agents/additives, provided that they do not interfere with the performance of the sliding interface. For instance, the first component may comprise a dye, anti-aging agent or colourant (in particular a dye or colourant) as a further agent. The first component is preferably composed primarily of the olefin polymer and the lubricant. Thus, the olefin polymer and the lubricant preferably account for at least 80% by weight of the first component, such as at least 85%, at least 90%, at least 95%, at least 97%, or at least 98% by weight. Said further optional agents/additives preferably account for at most 20 by weight of the first component, such as at most 15%, at most 10%, at most 5%, at most 3%, or at most 2% by weight.

In this regard, for the avoidance of doubt it may be noted that all of the aspects, embodiments, etc of the first component as set out above also apply specifically to the sliding surface of the first component.

Thus, by way of example, in one preferred embodiment the first component (or the sliding surface thereof) comprises:

(i) 50 to 98% by weight of a random ethylene-propylene copolymer wherein propylene units account for 85 to 99.5% by weight of the copolymer (preferably 93 to 99.0% by weight) and ethylene units account for 0.5 to 15% by weight of the olefin polymer (preferably 1.0 to 7% by weight); and (ii) 2 to 50% by weight of an polyethylene homopolymer wax.

The olefin polymer, the lubricant, and one or more further optional agents are present in the first component in the form of a mixture. Preferably the mixture is a substantially homogeneous mixture. Preferably the mixture is obtained or obtainable by a process as defined further below.

Option (b) for the First Component

In option (b), the first component comprises an ultra high molecular weight (UHMW) polymer having a density of ≤960 kg/m$^3$. In this regard, it may be noted that UHMW polymers are known in the art, and are among various types of material that have been mentioned before for use in helmets—see e.g. WO 2011/139224, wherein ultra high molecular weight polyethylene (UHMWPE) is mentioned. UHMWPE can come in different forms. For instance, UHMWPE fibers under the trade name Dyneema® have been described. The fibers are said to combine excellent mechanical properties with low density, resulting in high performance-on-weight basis. The density ranges from 970 to 980 kg/m$^3$. The UHMW polymers for use in the present invention, which have been found to be particularly useful for constructing helmets that offer robust protection against oblique impacts, have a lower density than this, namely a density of ≤960 kg/m$^3$.

Preferably, the UHMW polymer has a density of ≤955 kg/m$^3$, such as ≤950 kg/m$^3$, ≤945 kg/m$^3$, or ≤940 kg/m$^3$. Typically it has a density of ≤935 kg/m$^3$.

Preferably the UHMW polymer has a density of ≥900 kg/m$^3$, such as ≥905 kg/m$^3$, ≥910 kg/m$^3$, ≥915 kg/m$^3$, or ≥920 kg/m$^3$. Typically it has a density of ≥925 kg/m$^3$.

Preferably the UHMW polymer has a density of from 910 to 950 kg/m$^3$, more preferably 920 to 940 kg/m$^3$, more preferably still 925 to 935 kg/m$^3$, and typically it has a density of around 930 kg/m$^3$.

Density is preferably measured using ISO 1183 (and typically according to Method A described therein).

The UHMW polymer may be used in combination with one or more further agents. Thus, in one embodiment the first component comprises a mixture of the UHMW polymer and one or more further agents.

Preferably the UHMW polymer is organic, i.e. it contains carbon. More preferably it is based primarily on carbon and hydrogen, and has predominantly hydrocarbon properties.

Thus, preferably there is less than one atom which is other than carbon or hydrogen for every 10 carbon atoms present. Typically the UHMW polymer is a hydrocarbon, i.e. it consists essentially of only carbon and hydrogen atoms. Preferably, the UHMW polymer is an UHMW olefin polymer.

Preferably, the UHMW polymer is a linear polymer, more preferably a linear olefin polymer. More preferably still, the linear UHMW olefin polymer is linear polyethylene.

Typically the UHMW polymer may be a homopolymer.

Preferably, the UHMW polymer comprises straight or branched alkylene units having 2 to 6 carbon atoms, i.e. they may be ethylene, propylene, butylene, pentylene and/or hexylene. More preferably, the alkylene units have 2 to 5 carbon atoms, more preferably still 2 to 4 carbon atoms, and most preferably 2 or 3 carbon atoms (i.e. most preferably they are ethylene and/or propylene). Typically, the UHMW polymer comprises ethylene units. (In a particularly preferred embodiment, the UHMW polymer is polyethylene.)

Preferably, the alkylene units are derived or derivable from one or more alkenes selected from alkenes having 2 to 6 carbons, such as ethene, propene, 1-butene, cis-2-butene, trans-2-butene, isobutylene, 1-pentene, cis-2-pentene, trans-2-pentene, 2-methylbut-1-ene, 3-methylbut-1-ene (isopentene), 2-methylbut-2-ene (isoamylene), 1-hexene, cis-2-hexene, trans-2-hexene, cis-3-hexene, trans-3-hexene, 2-methyl-1-pentene, 2-ethyl-1-butene, cis 3-methyl-2-pentene, trans 3-methyl-2-pentene, and 2,3-dimethyl-2-butene. More preferably they are derived or derivable from one or more alkenes selected from alkenes having 2 to 5 carbon atoms, more preferably still 2 to 4 carbon atoms, and more preferably still 2 or 3 carbon atoms (i.e. ethene and/or propene). Typically they are derived from ethene.

Preferably the alkylene units are derived or derivable from one or more alpha olefins, i.e. alkenes having a double bond at the primary (or alpha) position. Preferably the straight or branched alkylene units are derived or derivable from one or more alpha olefins having 2 to 6 carbon atoms (i.e. ethene, propene, 1-butene, 1-pentene, and/or 1-hexene), more preferably 2 to 5 carbon atoms, more preferably still 2 to 4 carbon atoms, and most preferably 2 or 3 carbon atoms—i.e. most preferably the straight or branched alkylene units are derived or derivable from ethene and/or propene. Typically the UHMW polymer comprises units derived or derivable from ethene.

It is possible to incorporate other units in the UHMW polymer (e.g. besides the straight or branched $C_{2-6}$ alkylene units), provided that they do not interfere with the performance of the sliding interface. For instance, in some cases it may be possible to include longer alkylene units (e.g. units containing more than 6 carbon atoms), substituted alkylene units wherein the substituents are moieties which do not interfere with the performance of the sliding interface, and/or inert spacer groups. Typically such other units would be present only in minor amounts, though, and the straight or branched $C_{2-6}$ alkylene units account for the majority of the UHMW polymer. Preferably the straight or branched $C_{2-6}$ alkylene units account for at least 80% by weight of the UHMW polymer, more preferably at least 90% by weight, such as at least 95%, at least 98%, or at least 99% by weight. Typically the straight or branched $C_{2-6}$ alkylene units account for substantially all of the UHMW polymer, e.g. at least 99.9% by weight, at least 99.99% by weight, or at least 99.999% by weight.

An UHMW polymer is a polymer having relatively long polymer chains. Preferably the term UHMW polymer refers to a polymer having (i) an average molecular weight as obtained from intrinsic viscosity measurements (Mv) of at least $1.0\times10^6$ g/mol; and/or (ii) a relative viscosity of 1.44 or greater, in accordance with the test procedures described in ASTM D4020.

The UHMW polymer preferably has an average molecular weight (Mv) of at least $1.0\times10^6$ g/mol, such as at least $1.5\times10^6$ g/mol, at least $2.0\times10^6$ g/mol, at least $2.5\times10^6$ g/mol, or at least $3.0\times10^6$ g/mol.

The UHMW polymer preferably has an average molecular weight (Mv) of no more than $20.0\times10^6$ g/mol, such as no more than $15.0\times10^6$ g/mol, no more than $12.0\times10^6$ g/mol, or no more than $10.0\times10^6$ g/mol. In some preferred embodiments it is no more than $8.0\times10^6$ g/mol, such as no more than $7.0\times10^6$ g/mol, no more than $6.0\times10^6$ g/mol, no more than $5.0\times10^6$ g/mol, or no more than $4.0\times10^6$ g/mol.

Preferably, the UHMW polymer has an average molecular weight (Mv) of 1.0 to 12.0 g/mol, such as 1.5 to 10.0 g/mol, 2.0 to 8.0 g/mol, or 2.5 to 5.0 g/mol. Typically it is from 3.0 to 4.0 g/mol.

The average molecular weight as obtained from intrinsic viscosity measurements (Mv) is preferably calculated using Margolies' Equation. In that equation Mv is calculated as $Mv=53{,}700\times[IV]^{1.49}$, wherein IV is the intrinsic viscosity. Intrinsic viscosity in this context may be measured in decalin at 135° C. (dl/g). In particular, intrinsic viscosity in this context may be measured according to ASTM D4020.

Preferably, the UHMW polymer has a melt flow rate (measured at 190° C., 21.6 kg load) of less than 0.1 g/10 min. Melt flow rate is preferably measured using ISO 1133.

Preferably, the UHMW polymer has an intrinsic viscosity of at least 1000 $cm^3/g$, such as at least 1100 $cm^3/g$, at least 1200 $cm^3/g$, at least 1300 $cm^3/g$, at least 1400 $cm^3/g$, or at least 1500 $cm^3/g$.

Preferably, the UHMW polymer has an intrinsic viscosity of 3500 $cm^3/g$ or less, such as 3000 $cm^3/g$ or less, 2500 $cm^3/g$ or less, 2200 $cm^3/g$ or less, 2000 $cm^3/g$ or less or 1900 $cm^3/g$ or less.

Thus, the UHMW polymer preferably has an intrinsic viscosity of 1000 to 3500 $cm^3/g$, more preferably 1200 to 2200 $cm^3/g$. Typically, it is from 1500 to 1900 $cm^3/g$. In a particularly preferred embodiment, the UHMW polymer has an intrinsic viscosity of 1600 to 1800 $cm^3/g$, such as around 1700 $cm^3/g$.

Intrinsic viscosity is preferably measured using ISO 1628-3.

Preferably, the UHMW polymer has a tensile modulus of at least 500 MPa, such as at least 550 MPa, at least 600 MPa, at least 650 MPa, or at least 700 MPa.

Preferably, the UHMW polymer has a tensile modulus of 1100 MPa or less, such as 1050 MPa or less, 1000 MPa or less, or 950 MPa or less.

Thus, the UHMW polymer preferably has a tensile modulus of 600 to 1000 MPa, more preferably 650 to 950 MPa. Typically, it is from 700 to 900 MPa. In a particularly preferred embodiment, the UHMW polymer has a tensile modulus of around 800 MPa.

Tensile modulus is preferably measured using ISO 527-2/1B.

Preferably, the UHMW polymer has a tensile stress at yield of at least 15 MPa, such as at least 16 MPa, at least 17 MPa, at least 18 MPa, at least 19 MPa, at least 20 MPa, or at least 21 MPa.

Preferably, the UHMW polymer has a tensile stress at yield of 30 MPa or less, such as 29 MPa or less, 28 MPa or less, 27 MPa or less, 26 MPa or less, 25 MPa or less, or 24 MPa or less.

Thus, the UHMW polymer preferably has a tensile stress at yield of 20 to 25 MPa, more preferably 21 to 24 MPa. Typically, it is from 21 to 23 MPa. In a particularly preferred embodiment, the UHMW polymer has a tensile stress at yield of around 22 MPa.

Tensile stress at yield is preferably measured using ISO 527-2/1B.

Preferably, the UHMW polymer has a tensile strain at yield of at least 5%, such as at least 6%, at least 7%, at least 8% at least 9%, or at least 10%.

Preferably, the UHMW polymer has a tensile strain at yield of 19% or less, such as 18% or less, 17% or less, 16% or less, or 15% or less.

Thus, the olefin UHMW preferably has a tensile strain at yield of 8 to 16%, more preferably 9 to 15%. Typically, it is from 10 to 14%. In a particularly preferred embodiment, the UHMW polymer has a tensile strain at yield of around 12%.

Tensile strain at yield is preferably measured using ISO 527-2/1B.

Preferably, the UHMW polymer has a tensile stress at 50% strain of at least 10 MPa, such as at least 12 MPa, at least 14 MPa, at least 15 MPa, at least 16 MPa, or at least 17 MPa.

Preferably, the UHMW polymer has a tensile stress at 50% strain of 30 MPa or less, such as 28 MPa or less, 26 MPa or less, 24 MPa or less, 23 MPa or less, or 21 MPa or less.

Thus, the UHMW polymer preferably has a tensile stress at 50% strain of 15 to 23 MPa, more preferably 17 to 21 MPa. Typically, it is from 18 to 20 MPa. In a particularly preferred embodiment, the UHMW polymer has a tensile stress at 50% strain of around 19 MPa.

Tensile stress at 50% strain is preferably measured using ISO 527-2/1B.

Preferably, the UHMW polymer has a tensile stress at break of at least 30 MPa, such as at least 31 MPa, at least 32 MPa, at least 33 MPa, or at least 34 MPa.

Preferably, the UHMW polymer has a tensile stress at break of 45 MPa or less, such as 43 MPa or less, 42 MPa or less, 41 MPa or less, or 40 MPa or less.

Thus, the UHMW polymer preferably has a tensile stress at break of 33 to 41 MPa, such as 34 to 40 MPa. Typically, it is from 35 to 39 MPa, more typically 36 to 38 MPa. In a particularly preferred embodiment, the UHMW polymer has a tensile stress at break of around 37 MPa.

Tensile stress at break is preferably measured using ISO 527-2/1B.

Preferably, the UHMW polymer has a tensile nominal strain at break of at least 350%, such as at least 370%, at least 390%, at least 400% or at least 410%.

Preferably, the UHMW polymer has a tensile nominal strain at break of 500% or less, such as 480% or less, 470% or less, 460% or less, or 450% or less.

Thus, the UHMW polymer preferably has a tensile nominal strain at break of 400 to 460%, more preferably 410 to 450%. Typically, it is from 420 to 440%. In a particularly preferred embodiment, the UHMW polymer has a tensile nominal strain at break of around 430%.

Tensile nominal strain at break is preferably measured using ISO 527-2/1B.

Preferably, the UHMW polymer has a Charpy double 14° v-notch strength at 23° C. of at least 150 kJ/m$^2$, such as at least 160 kJ/m$^2$, at least 170 kJ/m$^2$, or at least 180 kJ/m$^2$.

Preferably, the UHMW polymer has a Charpy double 14° v-notch strength at 23° C. of 230 kJ/m$^2$ or less, such as 220 kJ/m$^2$ or less, 210 kJ/m$^2$ or less, or 200 kJ/m$^2$ or less.

Thus, the UHMW polymer preferably has a Charpy double 14° v-notch strength at 23° C. of 170 to 210 kJ/m$^2$, more preferably 180 to 200 kJ/m$^2$. Typically, it is from 185 to 200 kJ/m$^2$. In a particularly preferred embodiment, the UHMW polymer has a Charpy double 14° v-notch strength at 23° C. of around 190 kJ/m$^2$.

Charpy double 14° v-notch strength is preferably measured using ISO 11542-2.

Preferably, the UHMW polymer has a Shore D hardness (15 second measuring time) of at least 40, such as at least 43, at least 46, at least 49, at least 52, or at least 55.

Preferably, the UHMW polymer has a Shore D hardness (15 second measuring time) of 80 or less, such as 77 or less, 74 or less, 71 or less, 68 or less, or 66 or less.

Thus, the UHMW polymer preferably has a Shore D hardness (15 second measuring time) of 52 to 68, more preferably 55 to 66. Typically, it is from 58 to 65. In a particularly preferred embodiment, the UHMW polymer has a Shore D hardness (15 second measuring time) of around 62.

Shore D hardness is preferably measured using ISO 868.

Preferably, the UHMW polymer has a Vicat softening temperature (heating rate: 50° C./hour; load: 50 N) of at least 65° C., such as at least 70° C., at least 75° C., or at least 77° C.

Preferably, the UHMW polymer has a Vicat softening temperature (heating rate: 50° C./hour; load: 50 N) of 95° C. or less, such as 90° C. or less, 85° C. or less, or 83° C. or less.

Thus, the UHMW polymer preferably has a Vicat softening temperature (heating rate: 50° C./hour; load: 50 N) of 75 to 85° C., more preferably 77 to 83° C. Typically, it is from 78 to 82° C. In a particularly preferred embodiment, the UHMW polymer has a Vicat softening temperature (heating rate: 50° C./hour; load: 50 N) of around 80° C.

Vicat softening temperature is preferably measured using ISO 306.

Preferably, the UHMW polymer has a volume resistivity of greater than $1\times10^{12}$ Ohm*m. Volume resistivity is preferably measured using IEC 60093.

Preferably, the UHMW polymer has a surface resistivity of greater than $1\times10^{12}$ Ohm. Surface resistivity is preferably measured using IEC 60093.

The first component preferably comprises the UHMW polymer in an amount of at least 50% by weight, such as at least 60%, at least 70%, at least 80%, at least 90%, or at least 95% or at least 98% by weight. Thus, the first component preferably comprises the UHMW polymer in an amount of 50 to 100% by weight, such as 70 to 100% by weight, or 80 to 100% by weight.

The first component may also comprise further optional agents/additives, provided that they do not interfere with the performance of the sliding interface. For instance, the first component may comprise a dye, anti-aging agent or colourant (in particular a dye or colourant) as a further agent. Said further optional agents/additives preferably account for at most 50% by weight of the first component, such as at most 20%, at most 15%, at most 10%, at most 5%, at most 3%, or at most 2% by weight.

In this regard, for the avoidance of doubt it may be noted that all of the aspects, embodiments, etc of the first component as set out above also apply specifically to the sliding surface of the first component.

Thus, by way of example, in one preferred embodiment the first component (or the sliding surface thereof) comprises 80 to 100% by weight of the UHMW polymer, and up to 20% by weight of one or more further optional agents/additives.

When one or more further optional agents/additives are present, the UHMW polymer and said one or more further agents/additives are preferably present in the form of a mixture. Preferably the mixture is a substantially homogeneous mixture. Preferably the mixture is obtained or obtainable by a process as defined further below.

ALTERNATIVE EMBODIMENT

In an alternative embodiment, the present disclosure provides a helmet, comprising first and second components having a sliding interface between them, wherein the sliding interface is provided between respective sliding surfaces of the first and second components, and the first component comprises an ultra high molecular weight (UHMW) polymer, which UHMW polymer is preferably an olefin polymer, wherein said first component is obtained or obtainable by processing (and preferably injection molding) an UHMW polymer having a density of ≤960 kg/m$^3$.

Preferably, the UHMW polymer has a density of ≤955 kg/m$^3$, such as ≤950 kg/m$^3$, ≤945 kg/m$^3$, or ≤940 kg/m$^3$. Typically it has a density of ≤935 kg/m$^3$.

Preferably the UHMW polymer has a density of ≥900 kg/m$^3$, such as ≥905 kg/m$^3$, ≥910 kg/m$^3$, ≥915 kg/m$^3$, or ≥920 kg/m$^3$. Typically it has a density of ≥925 kg/m$^3$.

Preferably the UHMW polymer has a density of from 910 to 950 kg/m$^3$, more preferably 920 to 940 kg/m$^3$, more preferably still 925 to 935 kg/m$^3$, and typically it has a density of around 930 kg/m$^3$.

Density is preferably measured using ISO 1183 (and typically according to Method A described therein).

Certain preferred features of the UHMW polymer set out above in the section entitled "Option (b) for the first component" apply also to the UHMW polymer in this alternative embodiment (i.e. the UHMW polymer from which said first component is obtained or obtainable), namely those preferred features in the block of text which starts with the paragraph which commences "Preferably the UHMW polymer is organic", up to and including the paragraph which concludes "Surface resistivity is preferably measured using IEC 60093".

Also, in one aspect of the alternative embodiment, the first component is obtained or obtainable by processing (and preferably injection molding) an UHMW polymer having a density of ≤960 kg/m$^3$ in combination with one or more further agents. Thus, in one aspect the first component comprises a mixture of the UHMW polymer and one or more further agents.

Also in this alternative embodiment, the first component preferably comprises the UHMW polymer in an amount of at least 50% by weight, such as at least 60%, at least 70%, at least 80%, at least 90%, or at least 95% or at least 98% by weight. Thus, the first component preferably comprises the UHMW polymer in an amount of 50 to 100% by weight, such as 70 to 100% by weight, or 80 to 100% by weight.

The first component may also comprise further optional agents/additives, provided that they do not interfere with the performance of the sliding interface. For instance, the first component may comprise a dye, anti-aging agent or colourant (in particular a dye or colourant) as a further agent. Said further optional agents/additives preferably account for at most 50% by weight of the first component, such as at most 20%, at most 15%, at most 10%, at most 5%, at most 3%, or at most 2% by weight.

In this regard, for the avoidance of doubt it may be noted that all of the aspects, embodiments, etc of the first component as set out above also apply specifically to the sliding surface of the first component.

Thus, by way of example, in one preferred aspect the first component (or the sliding surface thereof) comprises 80 to 100% by weight of the UHMW polymer, and up to 20% by weight of one or more further optional agents/additives.

When one or more further optional agents/additives are present, the UHMW polymer and said one or more further agents/additives are preferably present in the form of a mixture. Preferably the mixture is a substantially homogeneous mixture. Preferably the mixture is obtained or obtainable by a process as defined further below.

Further Aspects of the Invention

The position of the first component within the helmet is not particularly limited, provided that the helmet comprises said first component plus a second component and that there is a sliding interface between the two components, wherein the sliding interface is provided between respective sliding surfaces of the first and second components.

As noted above, in a first arrangement, the helmet comprises at least one section having first and second layers, configured in use to be respectively further from the local surface of the head of a wearer of the helmet and closer to the local surface of the head of a wearer of the helmet; and the helmet is configured such that, in response to an impact on the helmet, the first layer can move relative to the second layer in a direction tangential to the local surface of the head. Preferred aspect of this arrangement include those wherein:

(a) the first layer comprises a relatively hard outer shell; the second layer comprises a shell formed from an impact energy absorbing material; and one of the first and second layers comprises the first component;

(b) the first and second layers comprise shells formed from an impact energy absorbing material; and one of the first and second layers comprises the first component;

(c) the first layer comprises a shell formed from an impact energy absorbing material; the second layer does not absorb a significant proportion of impact energy in comparison to the first layer, and one of the first and second layers comprises the first component (the second layer may comprise comfort padding);

(d) the helmet further comprises a connector, configured to connect the first and second layers of the helmet together but permit relative movement in the direction tangential to the local surface of the head in response to an impact on the helmet; wherein the connector comprises at least one of the first component and the second component; or (e) in addition to having the features of any one of (a) to (d) above, the helmet further comprises a connector, configured to connect the first and second layers of the helmet together but permit relative movement in the direction tangential to the local surface of the head in response to an impact on the helmet; wherein the connector comprises at least one of a second first component and a second second component.

The first component may be a sliding layer (or sliding facilitator) located between two parts of the helmet, which enables displacement between said two parts.

For instance, the first component may be a sliding layer (or a sliding facilitator) located between two layers (or shells) of the helmet, which enables displacement between said two layers (or shells). For example, the first component may be a sliding layer (or a sliding facilitator) located between an outer shell and an inner shell, which enables displacement between the outer shell and the inner shell. The inner shell may be an energy absorbing layer. The outer shell may be a relatively thin and strong material suitable for withstanding impact of various type, i.e. an impact resistant material. Alternatively, the outer shell may be a (second) energy absorbing layer. The second component may be either of the two layers (or shells) of the helmet. For instance, the second component may be the aforementioned inner shell or outer shell.

The first component may be a sliding layer (or a sliding facilitator) located between a layer (or shell) of the helmet and one or more connectors, which sliding layer (or facilitator) enables displacement between said layer (or shell) and said one or more connectors. The shell may be an energy absorbing layer. The second component may be said layer (or shell) of the helmet or said one or more connectors.

The first component may be one or more connectors configured to connect two parts of the helmet, wherein at least one of said two parts is a layer (or shell) of the helmet, and wherein the connector enables displacement between the two parts. The second component may be either of the two parts of the helmet—e.g. the second component may be the layer (or shell) of the helmet.

In one arrangement the second component may, independently, be defined in the same way as the first component is defined above, but this is not necessary for achieving the enhanced performance of the sliding interface. Thus, the nature of the second component is not particularly limited, and the second component may be composed of one or more other materials, such as those used to form one of the other parts of the helmet.

In one embodiment the second component comprises (and preferably is substantially composed of) an energy absorbing material. Preferably the material is a polymer. Preferably the material is a foam. Typically the material is a polymer in the form of a foam. Suitable foams include expanded polystyrene (EPS), expanded polypropylene (EPP), expanded polyurethane (EPU), and vinyl nitrile. These options for the second component are of particular relevance to arrangements where the second component is an energy absorbing layer (or shell) of the helmet.

In one embodiment the second component comprises (and preferably is substantially composed of) a relatively thin and strong material suitable for withstanding impact of various types, i.e. an impact resistant material. Preferred options for the impact resistant material in this regard and also generally herein, are polymer materials such as polycarbonate (PC), polyvinylchloride (PVC) or acrylonitrile butadiene styrene (ABS) for example. Advantageously, the polymer material can be fibre-reinforced, using materials such as glass-fibre, Aramid, Twaron, carbon-fibre or Kevlar. These options for the second component are of particular relevance to arrangements where the second component is an outer layer (or shell) of the helmet.

As well as providing a helmet, the present invention also provides a process of producing a component for a helmet, and a process of producing a helmet.

Thus, the present invention provides a process of producing a first component for use in forming a sliding interface in a helmet; wherein the sliding interface is provided between respective sliding surfaces of the first component and a second component of the helmet; and wherein the process comprises producing the first component, or an intermediate product from which the first component is formed, by a method which includes a step of forming a mixture of an olefin polymer, a lubricant, and optionally one or more further agents.

Preferred aspects of the olefin polymer and the lubricant in this regard are the same as those set out above in connection with the definition of the first component of the helmet of the invention.

In one aspect, the process comprises blending the olefin polymer, the lubricant, and said one or more further optional agents so as to form the mixture.

In one aspect, the process comprises injection molding the mixture to produce the first component.

In one aspect, the process comprises blending the olefin polymer, the lubricant, and said one or more further optional agents so as to form the mixture, and a subsequent step of injection molding the mixture to produce the first component. However, it is not necessary for the injection molding step to follow directly after the blending step. For instance, in one aspect the blending step may take place at one point in time, with the subsequent injection molding step taking place at a later point in time, potentially at a different location and/or after one or more additional intervening modification steps (provided that there remains a mixture comprising, inter alia, the olefin polymer and the lubricant).

The present invention also provides a process of producing a first component for use in forming a sliding interface in a helmet; wherein the sliding interface is provided between respective sliding surfaces of the first component and a second component of the helmet; and wherein the process comprises producing the first component, or an intermediate product from which the first component is formed, by a method which includes a step of providing an UHMW polymer having a density of $\leq 960$ kg/m$^3$. Optionally, one or more further agents are blended with the UHMW polymer to form a mixture, prior to molding.

Preferred aspects of the UHMW polymer and further agents in this regard are the same as those set out above in connection with the definition of the first component of the helmet of the invention.

In one aspect, the process comprises injection molding the UHMW polymer to produce the first component.

In one aspect, the process comprises injection molding a mixture of the UHMW polymer and one or more further agents to produce the first component. In one embodiment of this aspect, the process comprises forming a mixture of the UHMW polymer and one or more further agents (e.g. by blending), and then injection moulding said mixture of the UHMW polymer and one or more further agents to produce the first component.

Thus, in one aspect, the process comprises blending the UHMW polymer and one or more further optional agents so as to form a mixture, and a subsequent step of injection molding the mixture to produce the first component. However, it is not necessary for the injection molding step to follow directly after the blending step. For instance, in one aspect the blending step may take place at one point in time, with the subsequent injection molding step taking place at a later point in time, potentially at a different location and/or after one or more additional intervening modification steps (provided that there remains a mixture comprising, inter alia, the UHMW polymer and the one or more further agents).

The present invention also provides a process of producing a helmet, which process comprises producing a first component by a process as defined above, and a subsequent step in which the component is assembled into a helmet.

In one embodiment, the present invention provides the following numbered aspects [1] to [18].

[1] A helmet, comprising first and second components having a sliding interface between them, wherein the sliding interface is provided between respective sliding surfaces of the first and second components, and the first component comprises a mixture of (i) an olefin polymer, (ii) a lubricant, and optionally one or more further agents.

[2] A helmet according to aspect [1], wherein propylene units account for at least 50% by weight of the polymer.

[3] A helmet according to aspect [1] or [2], wherein the olefin polymer is an ethylene-propylene random copolymer.

[4] A helmet according to any one of the preceding aspects, wherein the lubricant is a wax.

[5] A helmet according to aspect [4], wherein the wax is a polyethylene homopolymer wax.

[6] A helmet according to any one of the preceding aspects, wherein the second component comprises an energy absorbing material.

[7] A helmet according to any one of the preceding aspects, wherein the helmet comprises at least one section having first and second layers, configured in use to be respectively further from the local surface of the head of a wearer of the helmet and closer to the local surface of the head of a wearer of the helmet; and the helmet is configured such that, in response to an impact on the helmet, the first layer can move relative to the second layer in a direction tangential to the local surface of the head.

[8] A helmet according to aspect [7], wherein the first layer comprises a relatively hard outer shell; the second layer comprises a shell formed from an impact energy absorbing material; and one of the first and second layers comprises the first component.

[9] A helmet according to aspect [7], wherein the first and second layers comprise shells formed from an impact energy absorbing material; and one of the first and second layers comprises the first component.

[10] A helmet according to aspect [7], wherein the first layer comprises a shell formed from an impact energy absorbing material; the second layer does not absorb a significant proportion of impact energy in comparison to the first layer, and one of the first and second layers comprises the first component.

[11] A helmet according to aspect [10], wherein the second layer comprises comfort padding.

[12] A helmet according to aspect [7], further comprising a connector, configured to connect the first and second layers of the helmet together but permit relative movement in the direction tangential to the local surface of the head in response to an impact on the helmet;

wherein the connector comprises at least one of the first component and the second component.

[13] A helmet according any one of aspects [8] to [11], further comprising a connector, configured to connect the first and second layers of the helmet together but permit relative movement in the direction tangential to the local surface of the head in response to an impact on the helmet;

wherein the connector comprises at least one of a second first component and a second second component.

[14] A process of producing a first component for use in forming a sliding interface in a helmet; wherein the sliding interface is provided between respective sliding surfaces of the first component and a second component of the helmet; and wherein the process comprises producing the first component, or an intermediate product from which the first component is formed, by a method which includes a step of forming a mixture of an olefin polymer, a lubricant, and optionally one or more further agents.

[15] A process according to aspect [14], wherein the olefin polymer and the lubricant are as defined in any one of aspects [2] to [5].

[16] A process according to aspect [14] or [15], which comprises blending the olefin polymer, the lubricant, and said one or more further optional agents so as to form the mixture.

[17] A process according to any one of aspects [14] to [16], which comprises injection molding the mixture to produce the first component.

[18] A process of producing a helmet, which process comprises producing a first component by a process as defined in any one of aspects [14] to [18], and a subsequent step in which the component is assembled into a helmet.

EXAMPLES

Samples were prepared and then subjected to testing to assess their ability to protect against impacts, and oblique impacts in particular. An angled anvil test rig was used. In each case the test was performed with a free-falling instrumented Hybrid III dummy head form and helmet which impacted a 45-degree angled impact anvil. The helmet contact point was controlled during the drop. The oblique impact results in a combination of linear/translational and angular/rotational acceleration that is more realistic than common test methods, where helmets are dropped in pure vertical impact to the horizontal impact surface. In the dummy head there is a system of nine accelerometers mounted to measure the linear/translational accelerations and rotational accelerations around all axes. The helmets were dropped from a height of 2.2 m, resulting in a vertical speed of approximately 6.2±0.05 m/s.

Three different impact locations with different impact directions were tested. These impacts are specified as Front (Y rotation) impact direction, lateral (X rotation) impact direction and pitched (Z rotation) impact direction. These impacts are depicted in FIG. 21. For the Front impact, rotational acceleration of the head/helmet is recorded around the Y-axis with an initial tilt of 0±1 degrees. For the pitched impact, rotational acceleration of the head/helmet is recorded around the Z-axis with an initial tilt of 25±1 degrees. For the lateral impact, rotational acceleration of the head/helmet is recorded around the X-axis with an initial tilt of 0±1 degrees. FIG. 22 (an adapted version of the Figure available from Ildar Farkhatdinov. Modelling verticality estimation during locomotion. Automatic. Université Pierre et Marie Curie—Paris VI, 2013. English) shows how the X, Y and Z-axes described above exist spatially in relation to the human head. Samples were tested for all three impact directions at room temperature.

In addition, $1^{st}$ principal strain values were computed by a validated Finite Element (FE) model of the human brain using the acceleration signals from the experimental data collected from the Hybrid III dummy head during impact testing (see (i) Kleiven, S. (2002), Finite Element Modeling of the Human Head. Doctoral Thesis. Technical Report 2002-9, Department of Aeronautics, Royal Institute of Technology, Stockholm, Sweden; (ii) Kleiven, S. (2006), Evaluation of head injury criteria using an FE model validated against experiments on localized brain motion, intra-cerebral acceleration, and intra-cranial pressure, International Journal of Crashworthiness 11 (1), 65-79; and (iii) Kleiven, S. (2007), Predictors for Traumatic Brain Injuries Evaluated through Accident Reconstructions, Stapp Car Crash Journal 51, 81-114). Helmets showing reductions of 10 to 60% in strain (compared to the same helmet without the first component) for all impact directions were considered to be significantly improved.

Example 1

Two helmets were made and subjected to testing to assess their ability to protect against impacts. The helmets differed only in terms of the presence/absence of a first component as defined herein, as set out below.

Helmet 1 was according to the invention. A first component was made by injection molding a blended mixture of a polypropylene random copolymer (Cosmoplene W531L) plus 15 wt. % of a polyethylene homopolymer wax (LP0020P) and a minor amount (2 g per kg) of dye. The first component was formed in the shape of a layer which was then assembled into a helmet. The first component was present in the form of a low friction layer arranged between an energy absorbing foam layer and the comfort padding which rests towards the test head form.

Helmet 2 (the control) was the same as helmet 1 subject to the omission of the first component.

The results in the lateral impact test are summarised below.

| Helmet Example | Resultant Translational Acceleration (g) | Resultant Rotational Acceleration (krad/s$^2$) | Resultant Rotational Velocity (rad/s) | 1$^{st}$ Principal Strain |
|---|---|---|---|---|
| 1 | 124.9 | 5.3 | 22.0 | 0.18 (18%) |
| 2 | 134.0 | 6.5 | 26.8 | 0.23 (23%) |

The effect of introducing the first component can be seen from the fact that Helmet 1 scores better (i.e. lower) than Helmet 2 in all of the measured properties. The size of the reductions in respect of the various properties in this regard are set out below.

| | Translational Acceleration | Rotational Acceleration | Rotational Velocity | 1$^{st}$ Principal Strain |
|---|---|---|---|---|
| Reduction (in score) due to addition of first component | 6.8% | 19.1% | 17.8% | 22.8% |

The effect that adding the first component has on 1$^{st}$ Principal Strain is particularly noteworthy.

Example 2

Two further helmets were made for the purpose of illustrating the effect of adding a first component lacking the lubricant. Thus, in Helmet 3 the first component was made from a blended mixture which differed from the one used to make Helmet 1 only in that the lubricant component (i.e. the polyethylene homopolymer wax) was absent. The blended mixture was then injection molded in a comparable way to the mixture in Helmet 1, to form the shape of a layer which was then assembled into a helmet. As with Helmet 1, this first component was incorporated within Helmet 3 in the form of a low friction layer arranged between an energy absorbing foam layer and the comfort padding which rests towards the test head form. The test scores for Helmet 3 in the lateral impact test are summarised below.

| Helmet Example | Resultant Translational Acceleration (g) | Resultant Rotational Acceleration (krad/s$^2$) | Resultant Rotational Velocity (rad/s) | 1$^{st}$ Principal Strain |
|---|---|---|---|---|
| 3 | 121.0 | 6.0 | 25.4 | 0.21 (21%) |

The effect of adding the first component (without the lubricant) into Helmet 3 may be seen by comparing the scores for Helmet 3 with those of a corresponding control helmet (Helmet 4) which differed from Helmet 3 only by virtue of the omission of the first component.

| | Translational Acceleration | Rotational Acceleration | Rotational Velocity | 1$^{st}$ Principal Strain |
|---|---|---|---|---|
| Reduction (in score) due to addition of first component | −1.7% | 13.2% | −0.6% | 2.8% |

These effects of adding the first component may be contrasted with those seen in Example 1 when the first component also comprised the lubricant. The inferior effect on 1$^{st}$ Principal Strain in the absence of the lubricant (2.8% vs 22.8%) is particularly noteworthy.

Example 3

Further helmets were prepared, which differed from Helmet 1 only in terms of the amount of lubricant used. Thus, Helmets 5 and 6 contained 10 wt. % and 5 wt. % of the lubricant component, respectively. These further helmets were subjected to testing in the same way as the Helmets discussed above, and no significant change in performance was seen between Helmets 1, 5 and 6. This indicates that the proportion of lubricant can be varied significantly without prejudicing the enhanced performance of the sliding interface reported above for Helmet 1.

Example 4

Six further helmets were prepared, some of which differed in that the first component was made using alternative materials. Each of these six further helmets had the same design. This design was comparable to the one of Helmets 1 to 6 above. The variation between the six further helmets is set out below.

Each of Helmets 7 and 8 was constructed in a similar way to Helmet 1 above. Thus, a first component was formed in the shape of a layer which was then assembled into a helmet wherein said first component was present in the form of a low friction layer arranged between an energy absorbing foam layer and the comfort padding which rests towards the test head form. In contrast to Helmet 1, though, the first component was formed by injection molding a blended mixture of a polypropylene random copolymer (Cosmoplene W531L) together with 10 wt. % of DuPont™ Zytel® nylon resin (a heat stabilized polyamide 66 resin modified with Teflon® PTFE Micropowder and Kevlar®, which is described as being able to offer low coefficients of friction) and a minor amount (2 g per kg) of dye.

Each of Helmets 9 and 10 (control samples) corresponded to Helmet 7 (and 8) except that (a) the blended mixture used to prepare the first component did not contain the nylon resin additive, and (b) sliding enablers (soft Velcros) were attached to the energy-absorbing layer to facilitate movement between the low friction layer and the energy-absorbing layer.

Each of Helmets 11 and 12 corresponded to Helmet 7 (and 8) subject to using 100 wt. % of DuPont™ Zytel® nylon resin to make the first component, rather than a blend thereof with polypropylene random copolymer (and a minor amount of dye).

The results obtained in the front impact test are summarised below.

| Helmet Example | Resultant Translational Acceleration (g) | Resultant Rotational Acceleration (krad/s$^2$) | Resultant Rotational Velocity (rad/s) | 1$^{st}$ Principal Strain |
|---|---|---|---|---|
| 7 | 114.7 | 6.6 | 34.3 | 0.35 (35%) |
| 8 | 117.9 | 6.9 | 34.1 | 0.34 (34%) |
| Average for 7 & 8 | 116.3 | 6.7 | 34.2 | 0.34 (34%) |
| 9 | 114.9 | 6.6 | 31.6 | 0.33 (33%) |
| 10 | 110.3 | 5.9 | 31.6 | 0.32 (32%) |
| Average for 9 & 10 | 112.6 | 6.2 | 31.6 | 0.32 (32%) |
| 11 | 110.5 | 5.8 | 31.0 | 0.31 (31%) |
| 12 | 114.9 | 6.1 | 32.0 | 0.32 (32%) |
| Average for 11 & 12 | 112.7 | 5.9 | 31.5 | 0.32 (32%) |

The average effects (relative to the control samples 9 and 10) seen for Helmets 7 & 8 and 11 & 12 are summarised in the following table.

| | Helmet numbers | Translational Acceleration | Rotational Acceleration | Rotational Velocity | 1$^{st}$ Principal Strain |
|---|---|---|---|---|---|
| Average reduction in score due to first component | 7 & 8 | −3.3% | −8.4% | −8.0% | −7.1% |
| | 11 & 12 | −0.1% | 4.5% | 0.3% | 0.7% |

When considering 1$^{st}$ Principal Strain properties in particular, it can be seen from the above analysis that there is no significant benefit to either (i) introducing into the polypropylene random copolymer a proportion of the commercial nylon resin additive which is described as being able to offer low coefficients of friction, or (ii) replacing the polypropylene random copolymer with the commercial nylon resin product. These results emphasize the surprising nature of the robust reduction in 1$^{st}$ Principal Strain which is seen when a first component comprising a mixture of an olefin polymer and a lubricant is used (as in Helmets 1, 5 and 6 above).

Example 5

Two further helmets were prepared to assess the protective ability of helmets at different impact locations with different impact directions. Helmet 13 was constructed in a similar way to Helmet 1 above. Thus, a first component was formed in the shape of a layer which was then assembled into a helmet wherein said first component was present in the form of a low friction layer arranged between an energy absorbing foam layer and the comfort padding which rests towards the test head form. The first component was formed by injection molding a blended mixture of a polypropylene random copolymer (Cosmoplene W531L) plus 15 wt. % of a polyethylene homopolymer wax (LP0020P) and a minor amount (2 g per kg) of dye.

Helmet 13 was subjected to front, lateral and pitched impact tests. Rotational velocity, rotational acceleration and translational acceleration were measured and the 1$^{st}$ principal strain calculated.

The effect of the first component in Helmet 13 on impact protection may be seen by comparing the scores for Helmet 13 with those of a corresponding control helmet (Helmet 14) which differed from Helmet 13 only by virtue of the omission of the first component. The percent reduction values for Helmet 13 compared to Helmet 14 are summarised in the table below.

| | Impact direction | Resultant Translational Acceleration | Resultant Rotational Acceleration | Resultant Rotational Velocity | 1$^{st}$ Principal Strain |
|---|---|---|---|---|---|
| Reduction (%) | Front | 5.5 | 41.6 | 34.1 | 39.9 |
| | Lateral | 9.3 | 47.4 | 42.9 | 36.5 |
| | Pitched | 17.4 | 38.4 | 32.6 | 26.6 |

The effect that adding the first component has on rotational acceleration and $1^{st}$ Principal Strain is particularly noteworthy.

Alternative Testing Method

The protective ability of helmets may also be analysed using a different methodology. To this end, samples may be prepared and then subjected to testing to assess their ability to protect against impacts. In each case the test is performed with a free falling instrumented dummy head which impacts a horizontally moving steel plate. The oblique impact results in a combination of translational and rotational acceleration that is more realistic than common test methods, where helmets are dropped in pure vertical impact to the horizontal impact surface. Speeds of up to 10 m/s (36 km/h) can be achieved both in horizontal and vertical direction. In the dummy head there is a system of nine accelerometers mounted to measure the translational accelerations and rotational accelerations around all axes. The helmets are dropped from 0.7 meter. This results in a vertical speed of 3.7 m/s. The horizontal speed may be 6.7 m/s, resulting in an impact speed of 7.7 m/s (27.7 km/h) and an impact angle of 29 degrees.

Two helmets may be made and subjected to testing to assess their ability to protect against impacts, with the helmets differing only in terms of the presence/absence of a first component as defined herein, as set out below.

A first helmet may be made according to the invention, with a first component being made by injection molding a blended mixture of a polypropylene random copolymer (Cosmoplene W531L) plus 15 wt. % of a polyethylene homopolymer wax (LP0020P) and a minor amount (2 g per kg) of dye. The first component is formed in the shape of a layer which is then assembled into a helmet. The first component may be present in the form of a low friction layer arranged between an energy absorbing foam layer and the comfort padding which rests towards the test head form.

The second helmet (the control) would be the same as the first helmet subject to the omission of the first component.

Example 6

Two further helmets were made and subjected to testing to assess their ability to protect against impacts. The helmets differed only in terms of the presence/absence of a first component as defined herein, as set out below.

Helmet 15 was according to the invention. A first component was made by injection molding a blended mixture of a UHMW polyethylene polymer (GUR® 5113). The first component was formed in the shape of a layer which was then assembled into a helmet. The first component was present in the form of a low friction layer arranged between an energy absorbing foam layer and the comfort padding which rests towards the test head form.

Helmet 16 (the control) was the same as helmet 15 subject to the omission of the first component.

The helmets were subjected to front, lateral and pitched impacts. Rotational velocity, rotational acceleration and translational acceleration were measured and the $1^{st}$ principal strain calculated. The results are summarised below.

| Helmet Example | Impact | Resultant Translational Acceleration (g) | Resultant Rotational Acceleration (krad/s$^2$) | Resultant Rotational Velocity (rad/s) | $1^{st}$ Principal Strain |
|---|---|---|---|---|---|
| 15 | Front | 102.0 | 3.2 | 14.9 | 0.15 (15%) |
| | Lateral | 125.6 | 5.1 | 23.7 | 0.25 (25%) |
| | Pitched | 98.8 | 3.8 | 16.5 | 0.20 (20%) |
| 16 | Front | 107.5 | 5.2 | 22.2 | 0.24 (24%) |
| | Lateral | 131.9 | 8.1 | 32.0 | 0.28 (28%) |
| | Pitched | 113.2 | 7.0 | 29.0 | 0.35 (35%) |

The effect of introducing the first component can be seen from the fact that Helmet 15 scores better (i.e. lower) than Helmet 16 in all of the measured properties. The size of the reductions in respect of the various properties in this regard are set out below.

| | Impact | Translational Acceleration | Rotational Acceleration | Rotational Velocity | $1^{st}$ Principal Strain |
|---|---|---|---|---|---|
| Reduction (%) | Front | 5.2 | 39.4 | 33.0 | 38.9 |
| | Lateral | 4.8 | 37.7 | 25.7 | 12.1 |
| | Pitched | 12.7 | 45.0 | 43.1 | 43.6 |

Again, the effect that adding the first component has on $1^{st}$ Principal Strain is particularly noteworthy.

The invention claimed is:

1. A helmet, comprising first and second components having a sliding interface between them, wherein the sliding interface is provided between respective sliding surfaces of the first and second components, and the first component comprises a mixture of (i) an olefin polymer comprising propylene units, and (ii) a lubricant.

2. The helmet according to claim 1, wherein the mixture further comprises one or more further agents.

3. The helmet according to claim 1, wherein propylene units account for at least 50% by weight of the polymer.

4. The helmet according to claim 1, wherein the olefin polymer is an ethylene-propylene random copolymer.

5. The helmet according to claim 1, wherein the lubricant is a wax.

6. The helmet according to claim 5, wherein the wax is a polyethylene homopolymer wax.

7. The helmet according to claim 1, wherein the second component comprises an energy absorbing material.

8. The helmet according to claim 1, wherein the helmet comprises at least one section having first and second layers, configured in use to be respectively further from the local surface of the head of a wearer of the helmet and closer to the local surface of the head of a wearer of the helmet; and the helmet is configured such that, in response to an impact on the helmet, the first layer can move relative to the second layer in a direction tangential to the local surface of the head.

9. The helmet according to claim 8, wherein the first layer comprises a relatively hard outer shell; the second layer comprises a shell formed from an impact energy absorbing material; and one of the first and second layers comprises the first component.

10. The helmet according to claim 8, wherein the first and second layers comprise shells formed from an impact energy absorbing material; and one of the first and second layers comprises the first component.

11. The helmet according to claim 8, wherein the first layer comprises a shell formed from an impact energy absorbing material; the second layer does not absorb a significant proportion of impact energy in comparison to the first layer, and one of the first and second layers comprises the first component.

12. The helmet according to claim 11, wherein the second layer comprises comfort padding.

13. The helmet according to claim 8, further comprising a connector, configured to connect the first and second layers of the helmet together but permit relative movement in the direction tangential to the local surface of the head in response to an impact on the helmet;

wherein the connector comprises at least one of the first component and the second component.

14. The helmet according to claim 9, further comprising a connector, configured to connect the first and second layers of the helmet together but permit relative movement in the direction tangential to the local surface of the head in response to an impact on the helmet;

wherein the connector comprises at least one of a second first component and a second component.

15. A process of producing a first component for use in forming a sliding interface in a helmet; wherein the sliding interface is provided between respective sliding surfaces of the first component and a second component of the helmet; and wherein the process comprises producing the first component, or an intermediate product from which the first component is formed, by a method which includes a step of forming a mixture of an olefin polymer comprising propylene units, and a lubricant.

16. The process according to claim 15, wherein the first component, or an intermediate product from which the first component is formed, is produced by a method which includes a step of forming the mixture with the olefin polymer comprising propylene units, the lubricant, and one or more further agents.

17. The process according to claim 15, wherein the process comprises blending the olefin polymer comprising propylene units, the lubricant, and said one or more further optional agents to form the mixture.

18. The process according to claim 15, which comprises injection molding the mixture to produce the first component.

19. A process of producing a helmet, which process comprises producing a first component by a process as defined in claim 15, and a subsequent step in which the component is assembled into a helmet.

20. The process according to claim 15, wherein propylene units account for at least 50% by weight of the olefin polymer comprising propylene units.

21. The process according to claim 15, wherein the olefin polymer comprising propylene units is an ethylene-propylene random copolymer.

22. A helmet, comprising first and second components having a sliding interface between them, wherein the sliding interface is provided between respective sliding surfaces of the first and second components, and the first component comprises a mixture of (i) an olefin polymer, and (ii) a polyethylene homopolymer wax.

* * * * *